US009079448B2

(12) United States Patent
Glosh et al.

(10) Patent No.: US 9,079,448 B2
(45) Date of Patent: Jul. 14, 2015

(54) PROJECT PLANNING METHOD

(71) Applicant: ACCO Brands Corporation, Lake Zurich, IL (US)

(72) Inventors: Amy E. Glosh, Kettering, OH (US); Edward P. Busam, Mason, OH (US); Richard L. Lane, Columbus, OH (US); Diana W. Juratovac, Columbus, OH (US)

(73) Assignee: ACCO BRANDS CORPORATION, Lake Zurich, IL (US)

( * ) Notice: Subject to any disclaimer, the term of this patent is extended or adjusted under 35 U.S.C. 154(b) by 0 days.

(21) Appl. No.: 14/098,961

(22) Filed: Dec. 6, 2013

(65) Prior Publication Data

US 2014/0131988 A1 May 15, 2014

Related U.S. Application Data

(62) Division of application No. 13/181,795, filed on Jul. 13, 2011, now abandoned.

(60) Provisional application No. 61/364,262, filed on Jul. 14, 2010.

(51) Int. Cl.
*B42D 5/04* (2006.01)
*B42D 15/00* (2006.01)
(Continued)

(52) U.S. Cl.
CPC ..... *B42D 15/00* (2013.01); *B42D 5/041* (2013.01); *B42D 13/00* (2013.01); *G09F 3/10* (2013.01)

(58) Field of Classification Search
CPC ..... B42D 5/04; B42D 15/00; B42D 1/009; B42D 5/042; B42D 5/047; B42D 15/0073; B42D 15/0086; B42F 21/00
USPC ..... 283/2, 3, 36, 67, 98, 99, 100, 101
See application file for complete search history.

(56) References Cited

U.S. PATENT DOCUMENTS 5,431,450 A 7/1995 Coleman
6,364,362 B1 * 4/2002 Severin ..... 283/17
(Continued)

FOREIGN PATENT DOCUMENTS

JP 2005335104 12/2005

OTHER PUBLICATIONS

Examination Report, Canadian Application No. 2,746,057 (Nov. 1, 2012).
(Continued)

*Primary Examiner* — Shelley Self
*Assistant Examiner* — Justin V Lewis
(74) *Attorney, Agent, or Firm* — Thompson Hine LLP

(57) ABSTRACT

A method for planning a project including accessing a worksheet with a list area and instruction indicia. The instruction indicia cues a user to write project-related information in the list area for at least two phases of a project, and the project-related information includes at least one of a time interval or a finish date for each project phase. The method includes writing project-related information in the list area of the worksheet and accessing a plurality of labels that each include project-related indicia. A label is selected that pertains to at least one phase of the project, and the label is secured to a date-range document at a location on the date-range document that correlates with the time interval or the finish date of the respective phase of the project.

2 Claims, 33 Drawing Sheets

(51) Int. Cl.
*B42D 13/00* (2006.01)
*G09F 3/10* (2006.01)

(56) References Cited

U.S. PATENT DOCUMENTS

2003/0072605 A1* 4/2003 Somerset et al. ..... 402/73
2004/0250209 A1 12/2004 Norcross
2005/0069847 A1 3/2005 Carter
2006/0123329 A1 6/2006 Steen
2007/0024049 A1* 2/2007 Armstrong et al. ..... 283/2
2008/0077870 A1 3/2008 Napoleon
2009/0068626 A1 3/2009 Schulken
2010/0154260 A1* 6/2010 Franco ..... 40/119
2011/0095516 A1 4/2011 Regenold et al.
2011/0095517 A1* 4/2011 Bell ..... 283/35
2011/0300520 A1* 12/2011 Harris et al. ..... 434/156

OTHER PUBLICATIONS

Office Action, U.S. Appl. No. 13/181,795 (Dec. 6, 2012).
Office Action, U.S. Appl. No. 13/181,795 (Sep. 6, 2013).

* cited by examiner

100

102

106

120

130

140

201B

201C

FIG. 40A
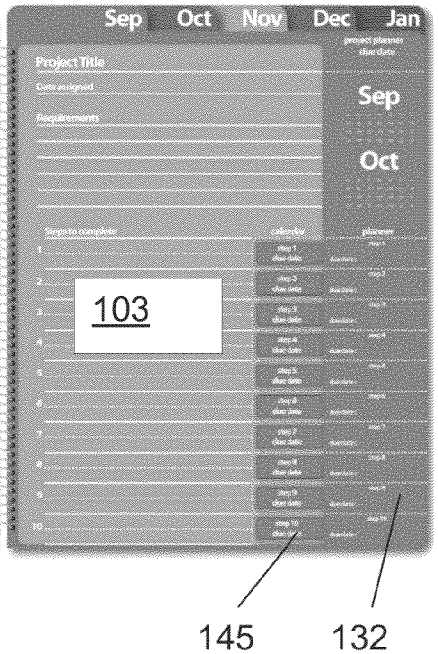
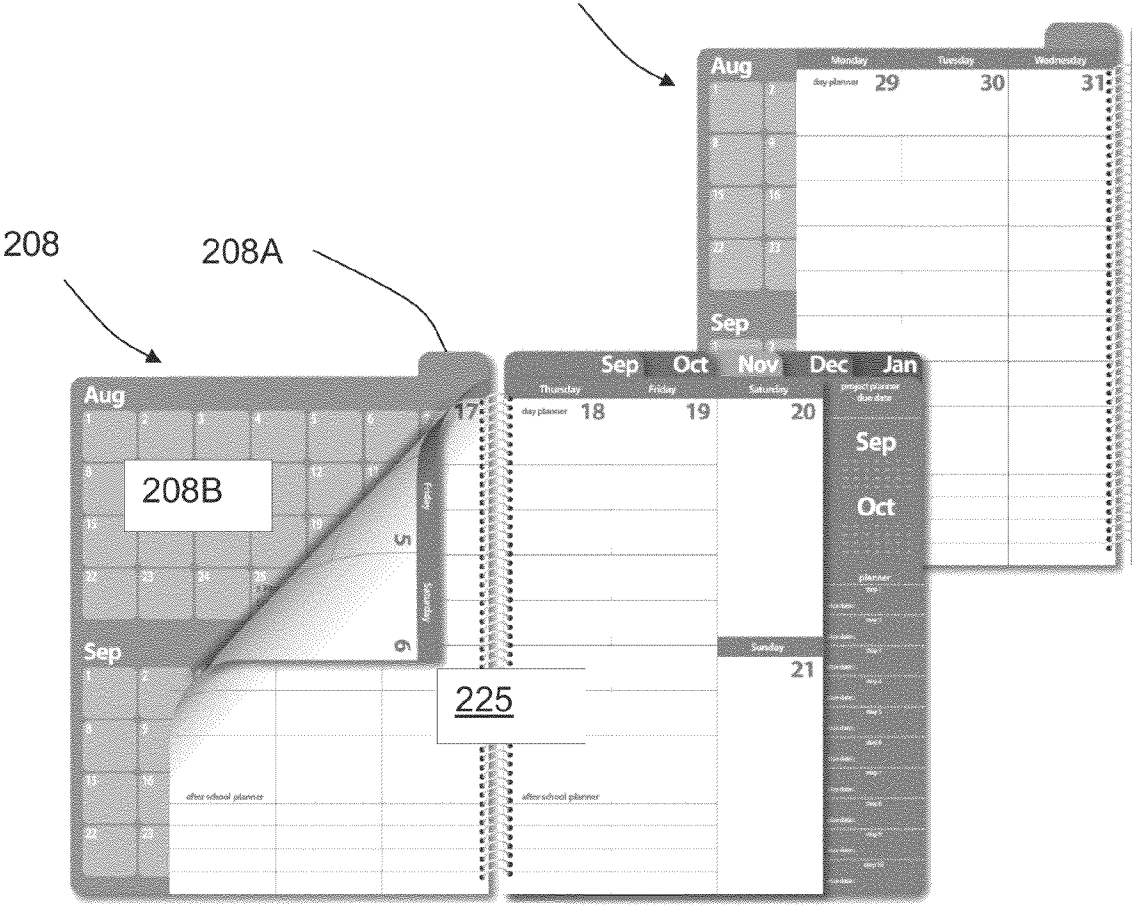
FIG. 40B

309A

209C

309B

209D

PROJECT PLANNING METHOD

REFERENCE TO RELATED APPLICATIONS

This application is a divisional of application Ser. No. 13/181,795, filed Jul. 13, 2011, which in turn claims the benefit of priority under 35 U.S.C. §119(e) of U.S. provisional application Ser. No. 61/364,262, filed Jul. 14, 2010. The entire contents of both of these applications are hereby incorporated by reference.

BACKGROUND

The present disclosure is directed to a method for project planning, and more particularly, to a worksheet, planner book and calendar for developing project planning skills.

Educational curriculums are increasingly using projects/project-based learning in teaching situations. As children and other users learn to undertake projects that last for extended periods of time (e.g. days or weeks), teachers are making increased use of project planning methods. It can be difficult for students to make the transition from short term assignments to the longer-term tasks involved in most project work. It would therefore be useful to have learning tools which help teach project planning to students.

Current planning items may list assignments and/or activities for a given day. Available planning tools for students do not address the scheduling challenges for project assignments that may be broader, longer, and involve more teamwork than assignments for the same grade levels of a few years ago. In a similar manner, available planning tools may not address students' needs in higher grades where projects become more complicated than in earlier grades.

SUMMARY

Project planning aids are disclosed herein to help students plan for projects involving multiple steps/activities that span extended time periods, for example projects that last longer than a week. In one embodiment the invention is a project planning system including a worksheet, a planner book, and a calendar.

The system may include multiple product formats, tools and content. Product formats may include planners, wall calendars, and desk pad calendars. Tools may include worksheets, stickers, and moveable template holders. System content may include prescriptive guidelines and templates, and instructions for defining projects and breaking them into manageable steps.

The disclosed system takes a systematic approach to planning with the goal of helping students to understand the "big picture" long term perspective of a project. To support this objective, the system of components, content, and tools may be used interactively such as planners and calendars whose contents are readily interchanged, worksheets, stickers and bookmarks that help quantify and track activities/tasks, and focused content that helps students plan and manage milestones as well as the tasks/activities/time needed to successfully complete them. The system may be implemented to address the planning needs of various levels of education including elementary school, middle school, high school and college.

Terms such as elementary school, grade school, middle school, high school and college are used herein to designate planners, calendars, worksheets etc. that may be suitable for particular grade levels. However, these terms are not meant to be limiting in any way. Instead of being used for school-related projects or activities, the planners, calendars and worksheets herein may be used for family-related projects and activities, for example planning a vacation, family reunion, home renovation project, household chores, and the like.

In one aspect, a method for planning a project is disclosed. The method includes accessing a worksheet, the worksheet including a list area and instruction indicia. The instruction indicia cues a user to write project-related information in the list area of the worksheet for at least two phases of a project, and the project-related information includes at least one of a time interval or a finish date for each of the at least two phases of the project. The method further includes writing project-related information in the list area of the worksheet and accessing a plurality of labels that each include project-related indicia thereon. The method includes selecting at least one of the plurality of labels that pertains to at least one of the at least two phases of the project, accessing a date-range document that corresponds to a date range that includes at least a portion of the time interval or the finish date for the at least one of the at least two phases of the project. The selected at least one of the plurality of labels to the date-range document is secured at a location on the date-range document that correlates with the time interval or the finish date of the respective phase of the project.

In another aspect, another method of project planning is disclosed. The method includes accessing a worksheet including pre-printed information and indicia cuing a user to input information pertaining to at least two phases of a project. The worksheet has a list area to receive the user-inputted information. The user inputs information pertaining to at least two phases of the project in the list area of the worksheet. The user-inputted information includes at least one of a time interval or a finish date for each of the at least two phases. The method further includes accessing a date-range document including indicia cuing the user to transfer at least some of the user-inputted information or the pre-printed information from the worksheet to the date-range document. The date-range document corresponds to a date range that includes at least a portion of the time interval or the finish date for at least one phase. The method also includes transferring at least some of the user-inputted information or the pre-printed information from the worksheet to the date-range document as cued by the indicia of the date-range document.

BRIEF DESCRIPTION OF THE DRAWINGS

FIGS. 40A and 40B illustrate two views of a planner; and

DETAILED DESCRIPTION

The dashed outlines in certain of the Figures are used to denote areas of certain sheets and are not necessarily printed or otherwise formed on the sheets.

Figure 1:
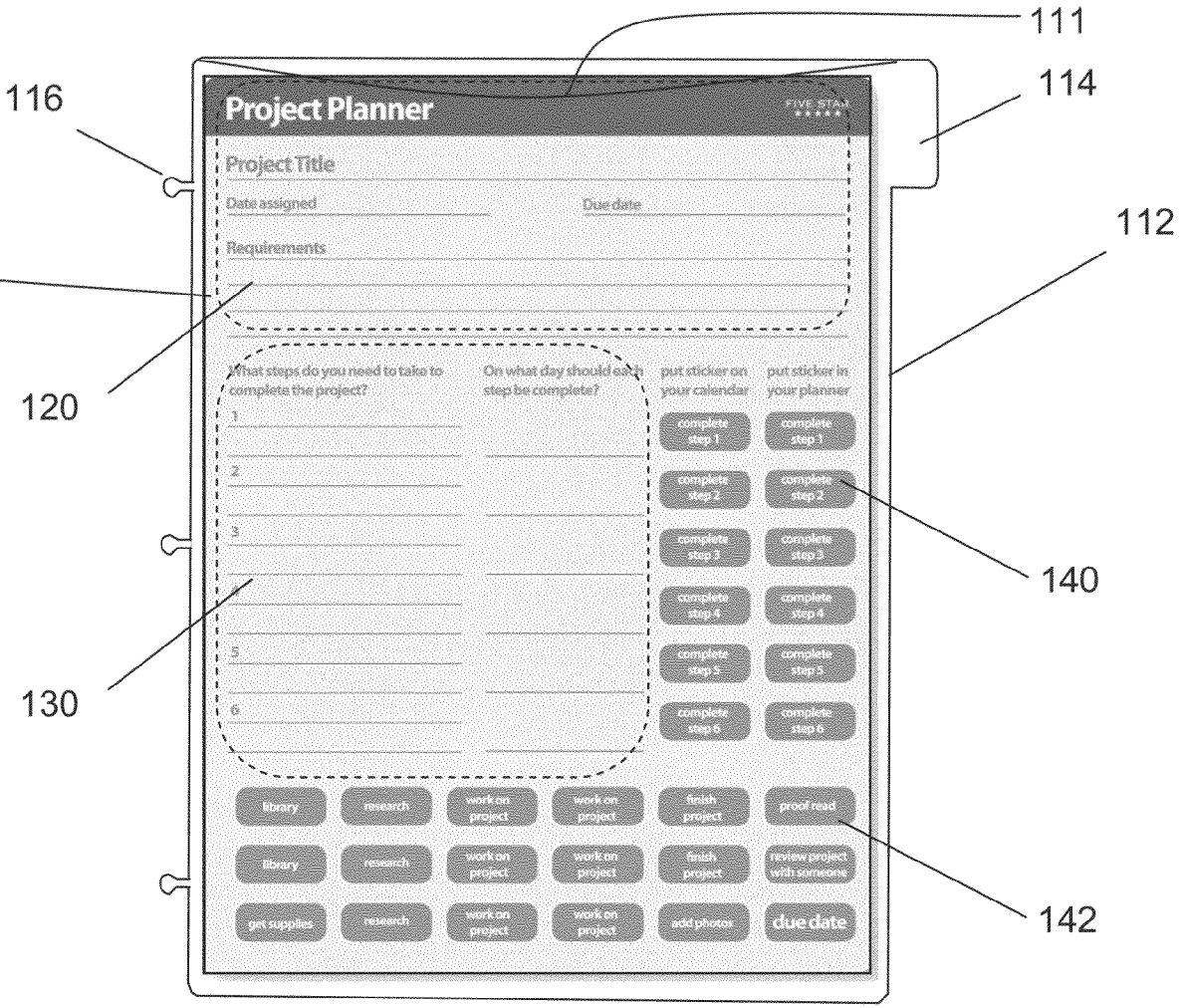
FIGS. 1 and 2 illustrate worksheets for use in project planning.

As shown in FIG. 1, a worksheet 100 may be provided in sheet form. The worksheet can be made of any of a wide variety of materials but will typically be made of a cellulose-based or pulp-based paper such that worksheet 100 is generally water absorbent and can be written upon by a wide variety of media (i.e. pens, pencils, markers, crayons, etc.) However, the worksheet 100 can be made of any of a relatively wide variety of materials, and need not necessarily be of a water-absorbent material (i.e. could be a write-on/wipe off (polymer) material that can be re-used, etc.) The worksheet 100 may be relatively thin. Multiple worksheets may be provided together, in either tablet form or as separate pages.

A worksheet 100 may, for example, include a heading area 120 to receive information such a project title, date assigned, due date, and requirements. The heading area may include indicia such as descriptive text, icons, ruling, etc. The worksheet may also include a list area 130 for listing steps required to complete the project, and an estimated finish date for each step. The list area could be provided with additional details, such as time required for each step, start date for each step, and other details. The list area may include indicia such as descriptive text, icons, ruling, etc.

Labels or stickers may be provided such as 140, 142 which may be step-related (such as "complete step 1") or generic (such as "research", "proofread", etc.) The labels 140, 142 may be removable from the worksheet 100, and may have a reusable adhesive backing. The labels may be formed separately from the worksheet and then attached thereto, or the labels may be formed in the worksheet, for example with die-cut separation lines in order to facilitate removal from the worksheet. The labels and/or the worksheet may be backed by a release liner. Although printed indicia are present on each label shown in FIG. 1, it should be understood that some or all labels may be blank or partly blank so that the user may write information on the labels, for example as required by whatever project is being worked on. The worksheet may comprise indicia such as printed information to instruct or guide a user on how to plan a project.

The worksheet may be supported on or held in a pocket 112 such as a transparent envelope or sleeve. The pocket 112 may be provided with an opening 111 through which to insert the worksheet, and with one or more tabs 114 and one or more attachment points 116, for example to attach the pocket 112 into a spiral binder, planner, etc. Alternately holes (not shown) may be provided in the pocket to facilitate placing in a ring binder. Similar to the pocket 112, the worksheet 100 itself may have tabs, attachment points, or holes.

Figure 2:
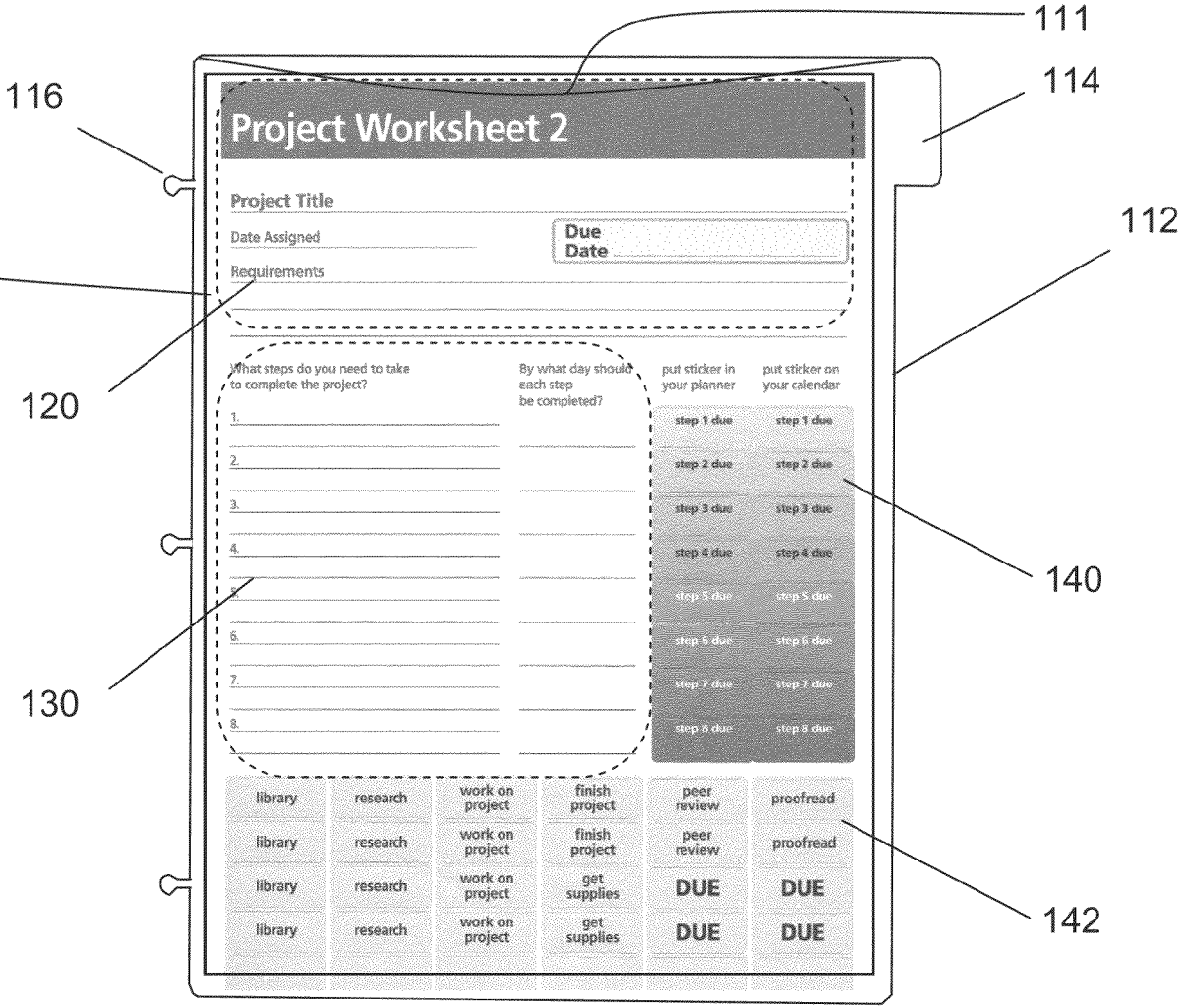

FIG. 2 shows a worksheet similar to that of FIG. 1, but with a slightly different format and with some differences in the labels 140, 142. For example instead of "complete step 1", a label may read "step 1 due." If desired, the labels (for this worksheet, or for any other labels described herein) may be colored or shaded and the coloring or shading may be graduated to indicate a progression along the project timeline. For example, the colors may progress from white to blue to yellow to red (or any other color sequence) as the project timeline proceeds, or the color or shading may be made darker (or lighter) as the project timeline proceeds.

Figure 4:
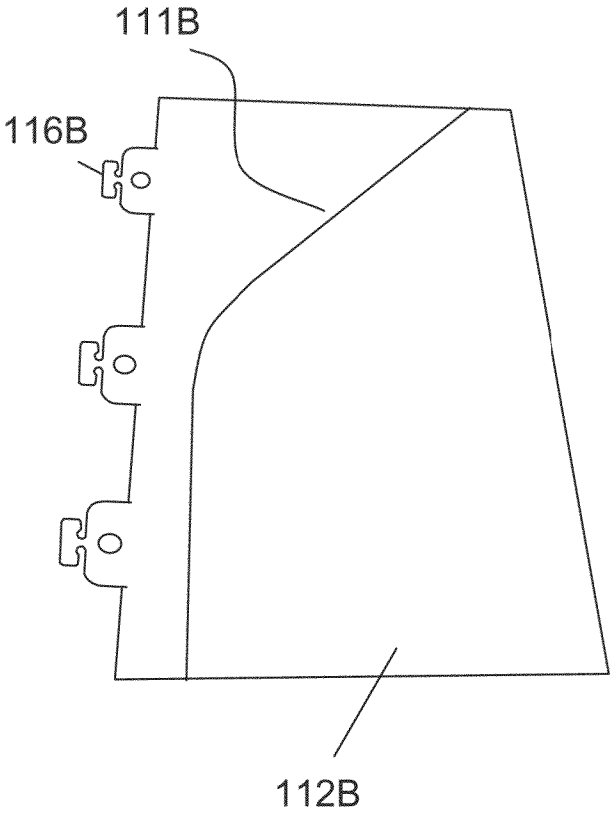
FIGS. 3 and 4 illustrate pockets for use with worksheets.
Figure 3:
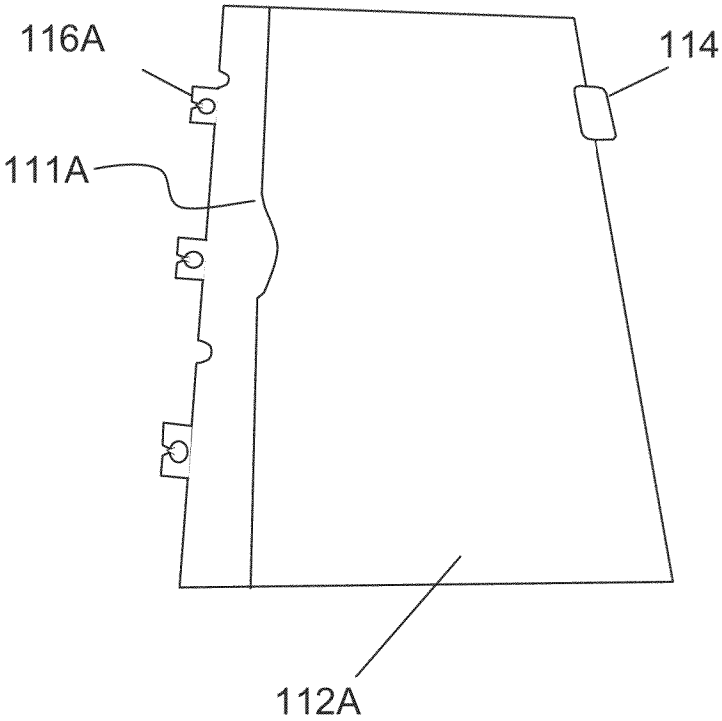

FIGS. 3 and 4 show alternative types of pockets 112A and 112B. For example pocket 112A is shown with a side opening 111A and with a different type of attachment point 116A, while pocket 112B is shown with a slash opening 111B and yet another type of attachment point 116B.

The worksheet 100 may be suitable for younger students, or students who are less experienced in project planning, time organization, and related skills. For example this may include middle school students or grade school students. The list area 130 may provide space for a relatively small number, e.g. six, project steps as may suit a younger student. A large number and variety of labels 140, 142 may be provided.

Figure 5:
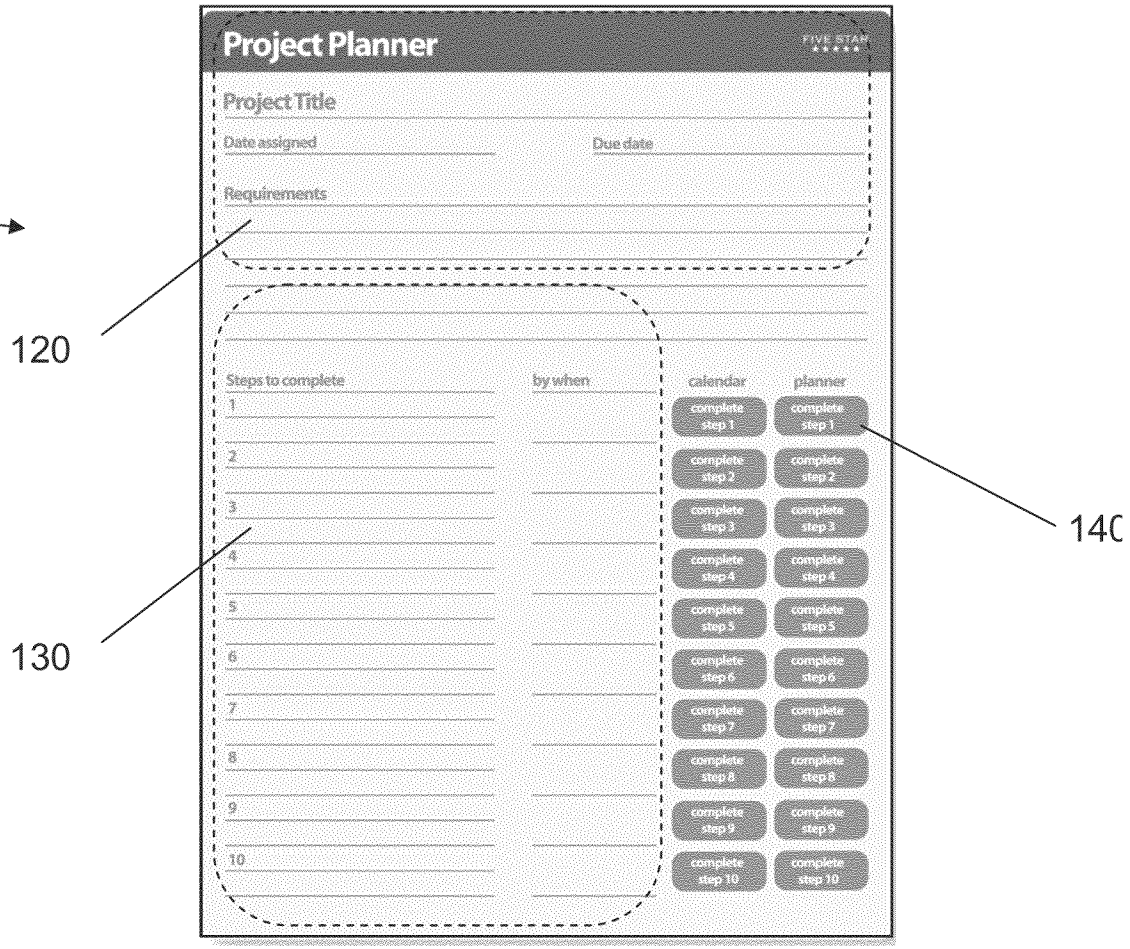
FIGS. 5-8 illustrate additional embodiments of worksheets.
Figure 6:
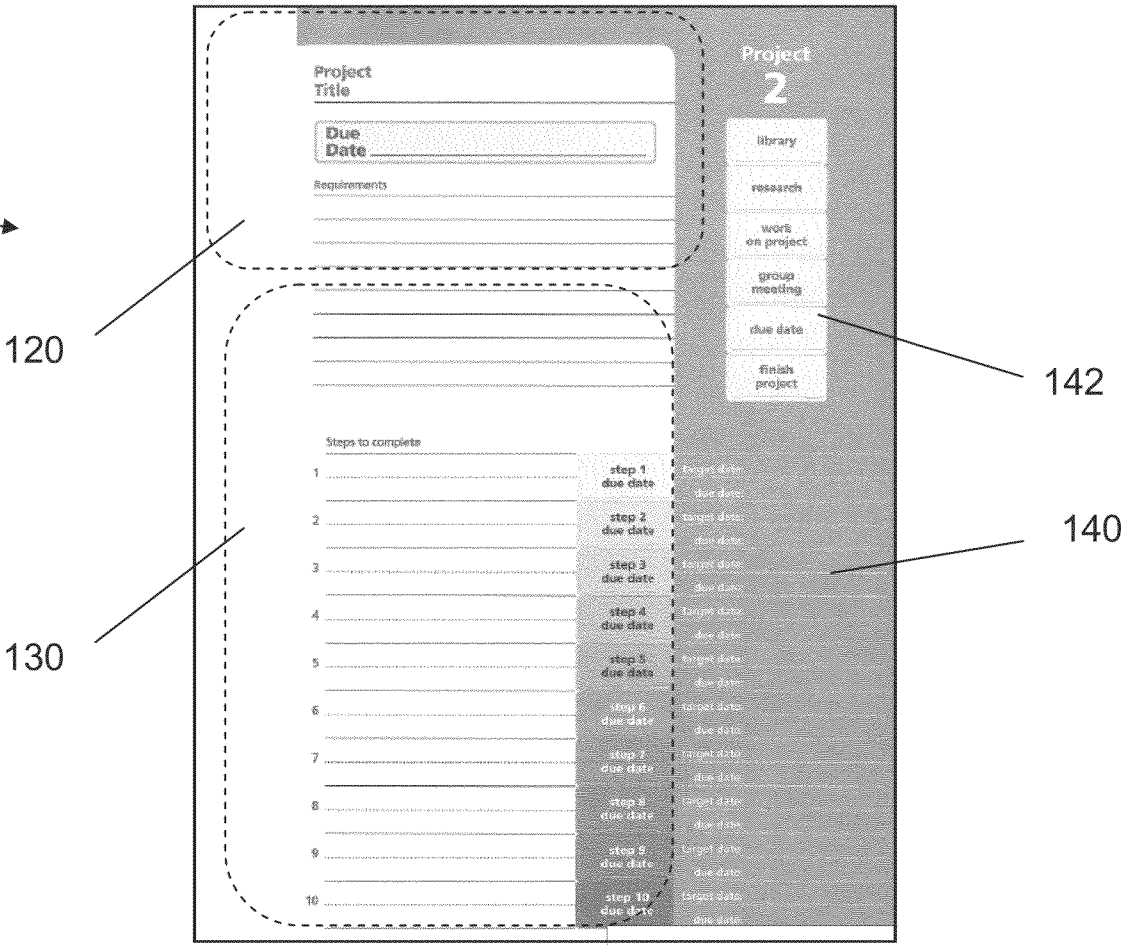

An example of a project that might be undertaken by younger students such as grade schoolers, may be a Book Report. For example, the phases of such a project, which would be recorded in the worksheet by the student, may include 1. Go to the library and find a book
2. Read the book
3. Draft an outline for the report
4. Write the report
5. Hand in the report FIG. 5 shows a worksheet 102 that may be suitable for somewhat older students, such as high school students or middle-school students, or students with some experience in project planning and time organization skills. The list area 130 may provide space for somewhat more, e.g. ten, project steps, whereas labels 140 may be fewer and of less variety. FIG. 6 shows a worksheet similar to that of FIG. 5, but with a slightly different format and with some differences in the labels 140. For example instead of "complete step 1", a label may read "step 1 due date" or "target date" or "due date." Also labels 142 may be provided, such as "library," "research," etc.

Figure 7:
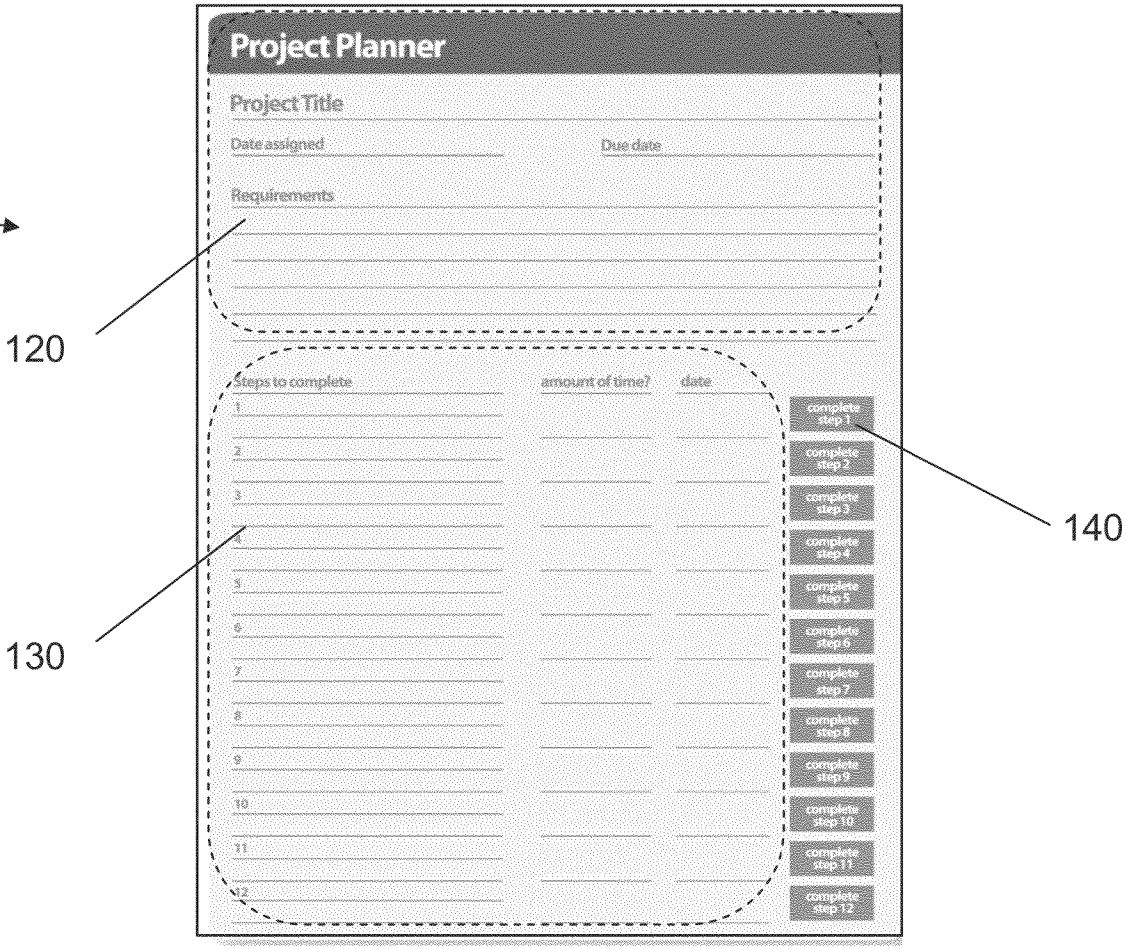

An example of a project that might be undertaken by a middle-school student may be a Science Project, whose phases might include 1. Ideate project themes/topics
2. Choose project theme
3. Define project
4. Research
   a. Go to the library
   b. Search the internet
   c. Set up a physical experiment and chart the progress
5. Draft an outline for the written report and/or project summary
6. Write the report
7. Purchase materials for visual aids
8. Develop visual aids
9. Hand in project Another example of a project that might be undertaken by a middle-school student may be a Canned Food Drive, whose phases might include 1. Identify charity (Food bank, local shelter, etc)
2. Secure sponsor and approval from school, church, club, etc.
3. Choose event collection date
4. Develop promotional materials
5. Print promotional materials
6. Distribute promotional materials 7. Identify collection teams and drivers
8. Collect canned foods
9. Measure collections
10. Deliver collections to charity
11. Communicate success and thank participants FIG. 7 shows a worksheet 104 that may be suitable for students, such as high school or college students, or students with more experience in project planning and time management. The list area 130 may provide space for still more, e.g. twelve, project steps, with more details such as amount of time required, and even fewer labels 140.

Figure 8:
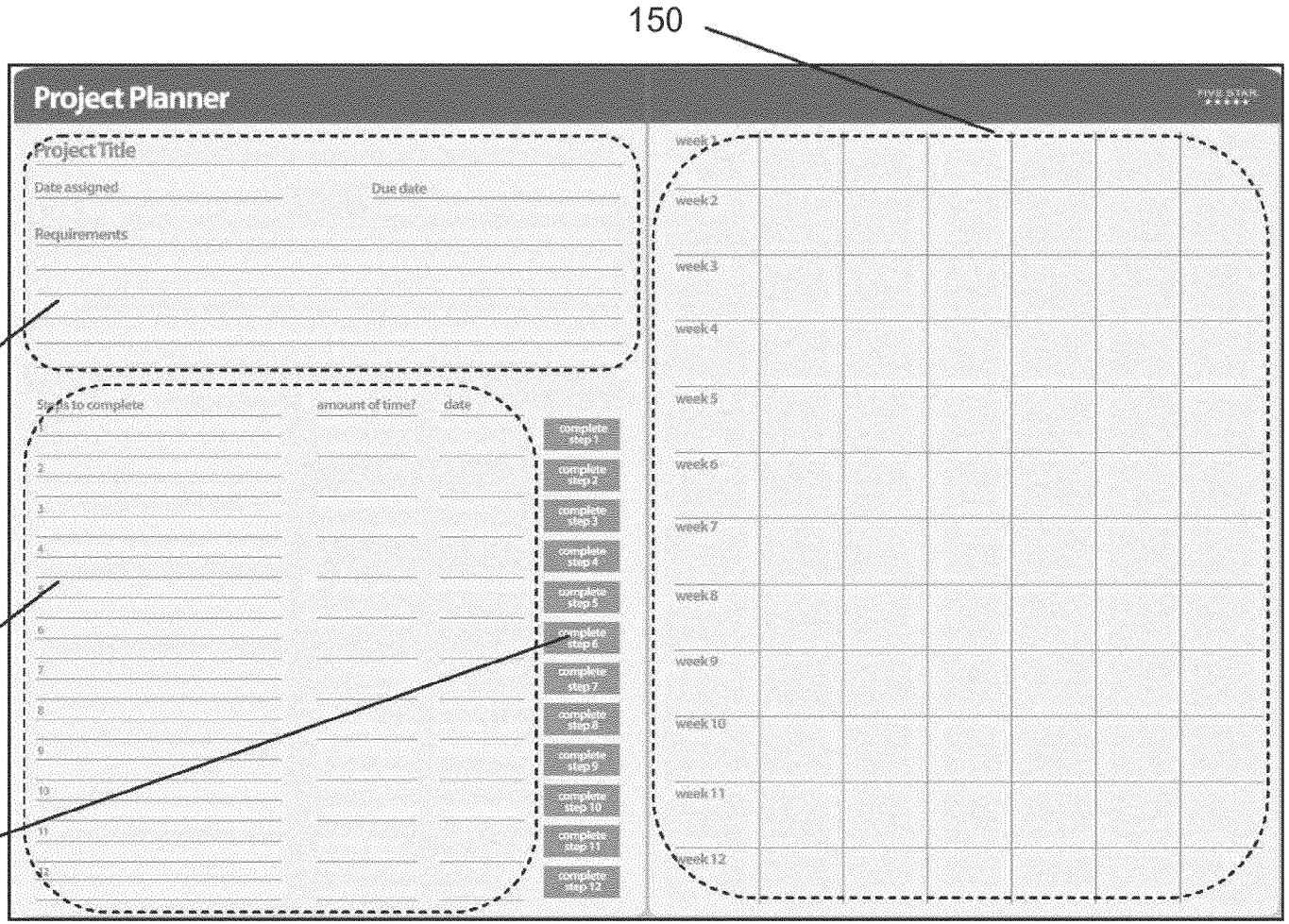

FIG. 8 shows a still more advanced worksheet 106, similar in some ways to worksheet 104, but additionally having a time-planning area 150, for example rows corresponding to a time interval (such as weeks or days) and columns corresponding to another time interval (such as days or hours).

Figure 9:
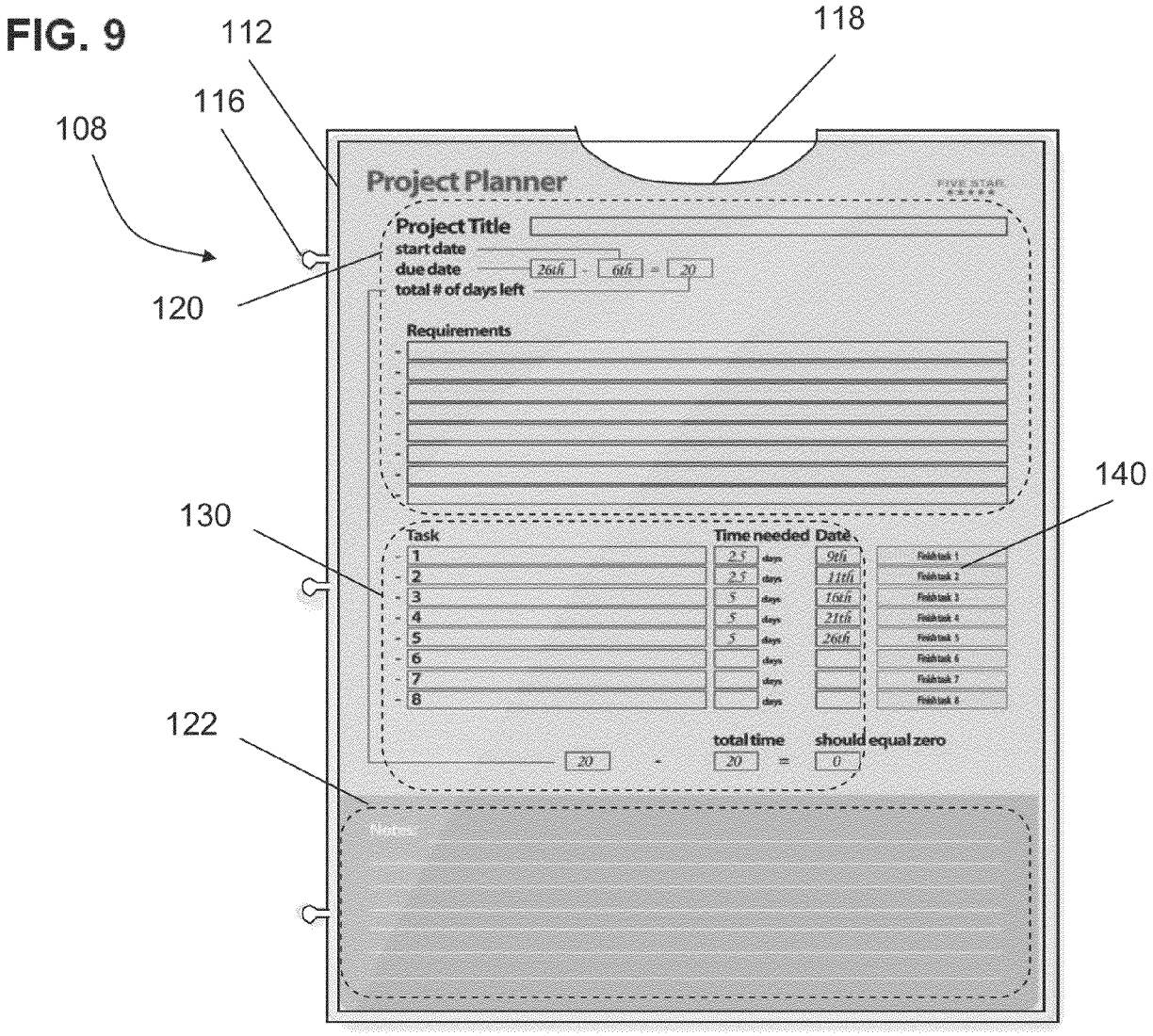
FIG. 9 illustrates a worksheet paired with a pocket.

FIG. 9 shows another worksheet 108 whose heading area 120 may include a calculation relating start date, due date, and number of days left. This may in turn be related to list area 130 whose steps to complete the project, may include itemized completion times (e.g. "time needed", for example "2.5" days) and an estimated or calculated finish date (for example "9th") for each step. A "notes" area 122 may be provided for example at the bottom of the worksheet.

Once again labels 140 may be provided which may be step-related (such as "Finish step 1"). The labels may be formed separately from the worksheet and then attached thereto, or the labels may be formed in the worksheet, for example with die-cut separation lines in order to facilitate removal from the worksheet. The labels and/or the worksheet may be backed by a release liner.

The worksheet may be supported on or held in a pocket 112 such as a transparent envelope or sleeve. The pocket 112 may be provided with one or more tabs (not shown) and one or more attachment points 116, for example to attach the pocket 112 into a spiral binder, planner, etc. Alternately holes (not shown) may be provided in the pocket to facilitate placing in a ring binder. The pocket may have a cutout 118 to facilitate storing or removing the worksheet. Similar to the pocket 112, the worksheet 108 itself may have tabs, attachment points, or holes.

A wide variety of projects may be planned, by students of various age groups. For example a project might be a Research Paper, whose phases might include 1. Identify Topic
2. Research topic
3. Draft outline
4. Submit draft to teacher for input/approval
5. Adjust outline as necessary based on teacher comments
6. Identify information sources/build bibliography
7. Write Paper
8. Hand paper in Another project example is Preparing for College Applications, whose phases might include 1. Identify colleges
2. Request application packets
3. Review application materials
4. Identify application deliverables
a. Application
b. References
c. Writing sample (paper)
d. Etc.
5. Establish time-table for each deliverable
6. Secure reference approvals
7. Identify writing topic
8. Outline paper
9. Draft paper
10. Review deliverables with parent, teacher, school counselor
11. Submit application materials Yet another project example is a Book Review, whose phases might include 1. Identify book
2. Read book
3. Draft outline
4. Write review
5. Practice reading review out loud
6. Revise review based on experience in saying it out loud
7. Practice with note cards
8. Practice without note cards
9. Give book review in class Another project example is Preparing for a Big Test, whose phases might include 1. Identify the Test Date
2. Investigate study aids:
a. Study guides/books/practice tests
b. Internet guides/tips/materials
c. Study groups
3. Identify and prioritize academic content (Math, Science, English comprehension, etc)
4. Study content X (Math)
5. Practice test for section X (Math)
6. Review X (Math) test for areas that need improvement
7. Study trouble areas for retesting X (Math)
8. Practice test for section X (Math)
9. Study content Y (Science) . . . could happen concurrently with above
10. Repeat process until . . .
11. Take actual test Project planning may involve more than one person. As an example, a Group Project may include the following phases 1. Identify group members
2. Select project topic
3. Assign tasks/areas of responsibility to group members (for example, 2 members might be responsible for the written presentation; 2 for the supporting visual aids; 2 will give the actual presentation)
4. Determine on-going group meeting time to gain consensus on objectives, monitor project progress, and provide input as required.
5. Work in sub-groups to complete tasks
6. Group meeting(s) to pull together components into a cohesive whole
7. Practice presentation with full group
8. Actual presentation to class and instructor Another example of a group project might be a School Social Event that may include the following phases 1. Identify theme and/or goal of event (for example, this could be a school dance)
2. Schedule date for the event (it's prom, some Saturday in the spring)
3. Establish a location for the event (the local country club)
4. Hold group meeting
a. Select chair people for sub-tasks (decorations, food, entertainment, publicity, finance, etc) (FOOD is used in this example)
b. Establish deadlines/schedule for overall project and various sub-tasks (will need to finalize the menu 2 weeks prior to the event working within a set budget and in conjunction with the cc chef; will need to have all food purchased the day before the event; will need to have all food prepared the morning of the event; will need to have all food cooked and served at 7 p.m.)

5. Hold/attend regular meetings for chair people (Food chairman meets with Finance/budget to establish budget, works with decorations on table flowers, works with publicity to get the menu in the program)
6. Hold/attend regular meetings for sub-tasks (Food chair recruits others to contact the chef and discuss the menu, work with decorations on the type of flowers for the tables, etc.)
7. Hold/attend regular meetings for all people (Food chair gives updates on status of the food committee)
8. Execute (confirms menu, food availability, etc)
9. Event: PROM Yet another example of a group project might be a Club Recruitment Drive that may include the following phases 1. Schedule a club meeting to discuss new recruitment efforts
2. Identify new member goal
3. Establish marketing goals for recruitment Start word of mouth campaign about the organization (talk it up)

Develop promotional materials to encourage interest and participation

4. Identify and announce recruitment campaign period
5. Solicit new members
6. Evaluate applicants
7. Communicate acceptance to new members
8. Schedule club meeting to introduce new members Still another example of a project might be an Athletic Fund-Raiser that may include the following phases 1. Identify goal of event (raising money for new uniforms)
2. Schedule date for the event (selling raffle tickets at all home basketball games) and a date for the drawing
3. Establish a location for the event (at all home basketball games)
4. Recruit assistants (ticket sellers for each game)
5. Remind participants of their commitment (contact ticket sellers the day before and day of each game)
6. Recruit assistants (student athletes) to make posters and flyers promoting the fund-raiser and the objective
7. Distribute flyers, hang posters
8. Distribute tickets and supplies, set-up table outside gym for raffle ticket sales
9. Collect money from sales and tickets after each event
10. Identify 3$^{rd}$ party and ask them to draw the winning ticket (Ass't principal picks during half time of the "big" basketball game)
11. Announce the winner and distribute earnings
12. Distribute funds raised to the budget for student athletics to support the uniform purchase Instead of being used for school—related projects and activities, the worksheets, calendars and planners may be used for family-related projects and activities, for example planning a vacation, family reunion, home renovation project, household chores, and the like. The worksheets may help define particular steps in such projects or activities, and may designate which family member or members are responsible for particular steps.

While worksheets may be useful in project planning, it is understood that planning may also be done without worksheets. For example, project planning may be done with planners and/or calendars. On the other hand, worksheets may also be used in conjunction with planners and/or calendars.

Figure 10:
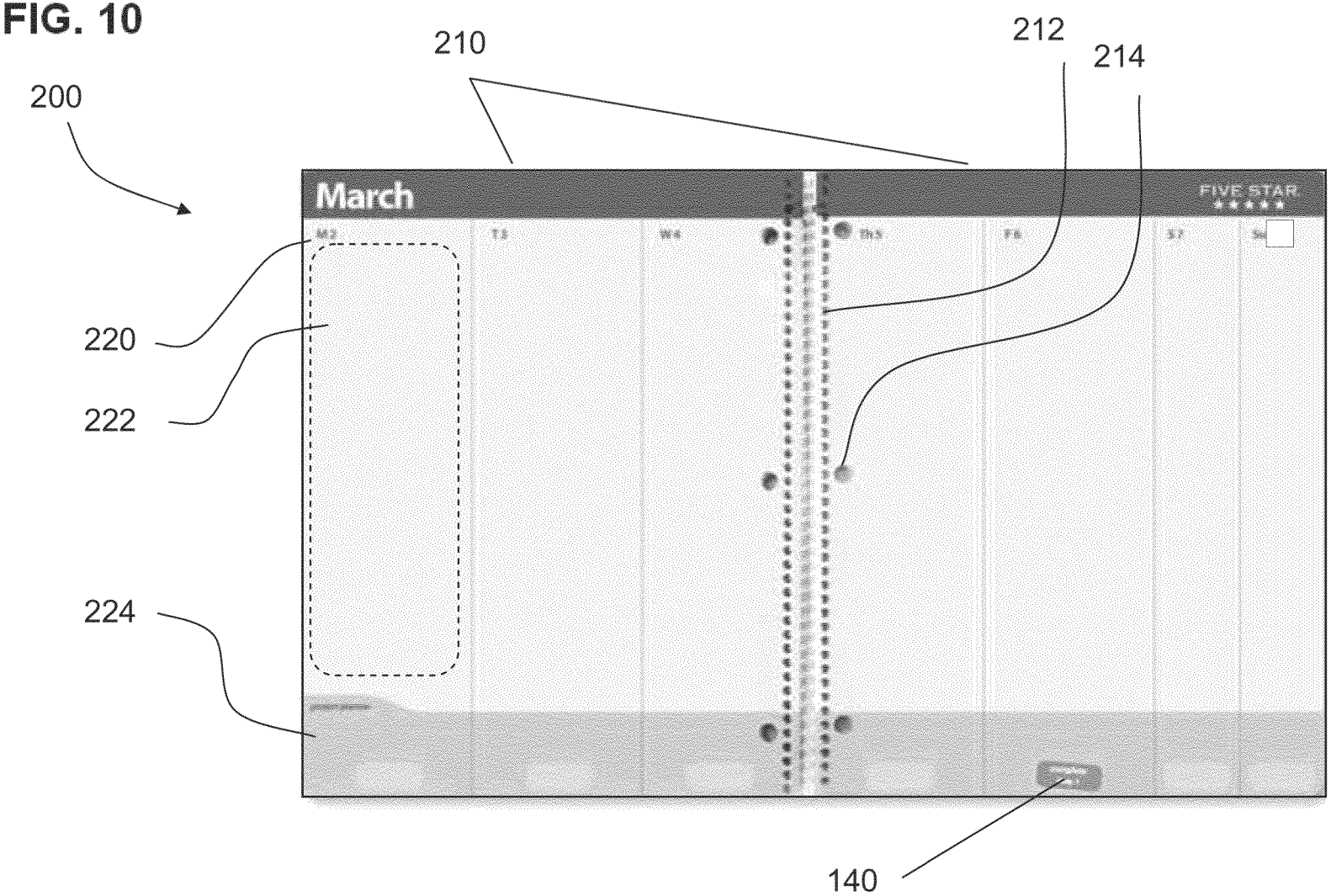
FIGS. 10-13 illustrate planners for use in project planning.

FIG. 10 shows a planner 200, which may comprise multiple pages, for example each covering one week as shown (e.g. starting from the left, as columns for the weekdays from Monday, March 2 to Friday, March 6, followed at the right by narrower columns for Saturday, March 7 and Sunday March 8. In this instance the week spans two side-by-side sheets 210 that are connected by a binding 212 such as a spiral binding. Holes 214 may be provided, for example to allow fitting planner 200 into a ring binder. Instead of presenting the days of the week in columns proceeding across the page, they may be presented in rows proceeding down the page. It is to be understood that pages could encompass multiple weeks, a month, or only a portion of a week.

A date indicia 220 such as "M2" (for Monday the 2nd) may be provided for each day of the week. An information area 222 may be provided in which the user may write information. A label-receiving area 224 may be provided which may receive labels 140 (alternately the labels could be placed in the information area 222. The labels 140 may be used to relate back to a worksheet 100, 102, 104, 106, 108 which may contain more (or less) information than the planner 200 or the information area 222. The labels 140 may be backed with a single-use adhesive or may be removably adherent so that they can be moved to another date if the project schedule changes. It is to be understood that the days of the week could be undated and the user could fill in the relevant dates (month, date etc). This may be useful when dealing with semesters in college or year round school.

Figure 11:
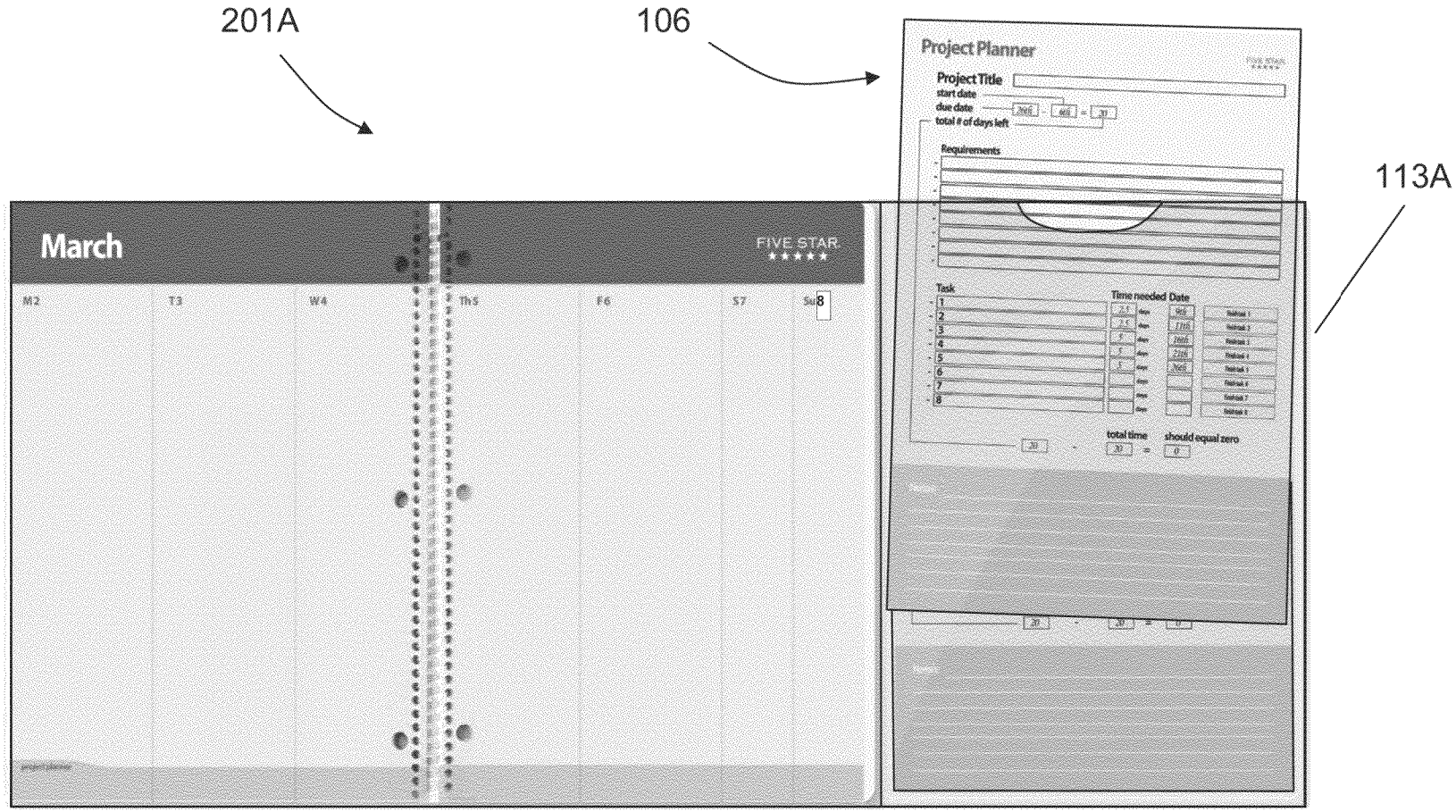

FIG. 11 shows another planner 201A with an attached pocket 113A, which may be used for example to hold one or more worksheets 100, 102, 104, 106. In this example pocket 113A may be formed as shown as a full-page pocket hingedly attached to a back cover of the planner, or to another part of the cover such as a front cover, front or back page, or page.

Figure 12:
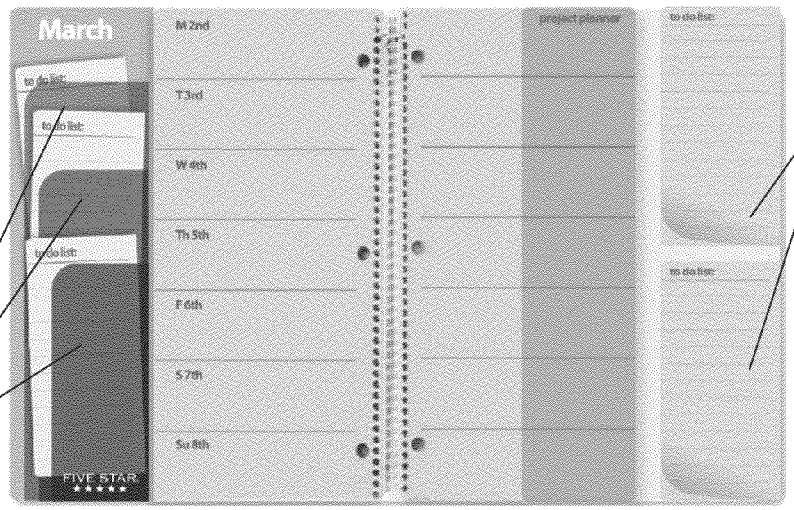
Figure 13:
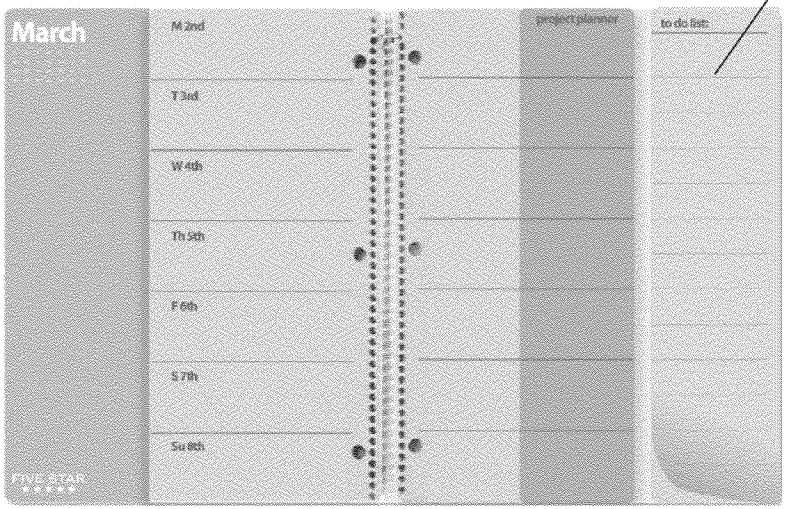

FIGS. 12 and 13 show other planners 201B and 201C. Planner 201B is shown with attached pockets, for example overlapping, partial-height pockets 113B. One or more non-overlapping pockets, as well as full-height pockets may also be used. These pockets may hold information such as To-Do Lists, bookmark cards, label cards, sticker cards, etc as described herein. Planners 201B and 201C may have attached notepads such as partial-height notepads 113C, or full-height notepads 113D. The pockets may be clear to allow the user to view the contents. It is to be understood the number, location, and material used for the pockets may be based on manufacturing preferences.

Figure 14:
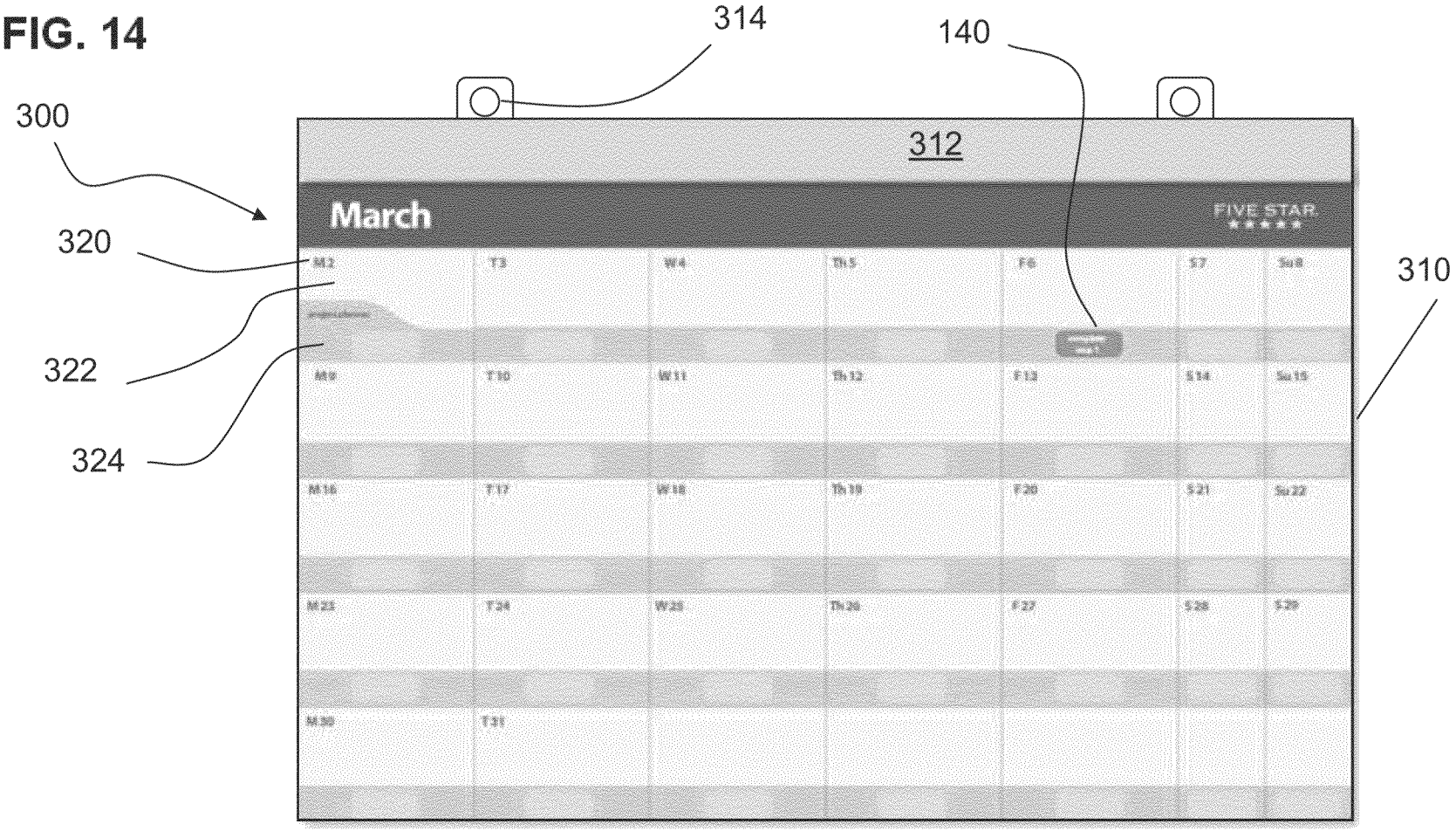
FIGS. 14-17 illustrate calendars for use in project planning.

FIG. 14 shows a calendar 300, which may comprise multiple pages 310, for example each covering one month as shown (e.g. starting from the left, as columns for days and rows for weeks of the month of March. In this instance the month occupies a single page 310, although more or less than one month may be placed on a single page. The pages may be connected by a binding 312 such as a glued, stapled, loose-leaf, spiral wire, clips, mechanical fasteners, or stitched binding, or any other type of binding. Mounting holes 314 may be provided either by devices separate from the calendar pages 310 (for example hooks, tabs, etc) or by holes directly punched through the calendar pages (not shown), for example to hang on a wall, although the calendar may also be provided with other mounting such as magnetic, or may be used on a horizontal surface such as a desk where it may serve as a desk pad.

A date indicia 320 such as "M2" (for Monday the 2nd) may be provided for each day of the month. An information area 322 may be provided in which the user may write information. A label-receiving area 324 may be provided which may receive labels 140 (alternately the labels could be placed in the information area 322. The labels 140 may be used to relate back to a worksheet 100, 102, 104, 106, 108 which may contain more (or less) information than the calendar 300 or the information area 322. The labels 140 may be removably adherent so that they can be moved to another date if the project schedule changes. Furthermore the labels may be moved between worksheet, planner, and calendar.

Figure 15:
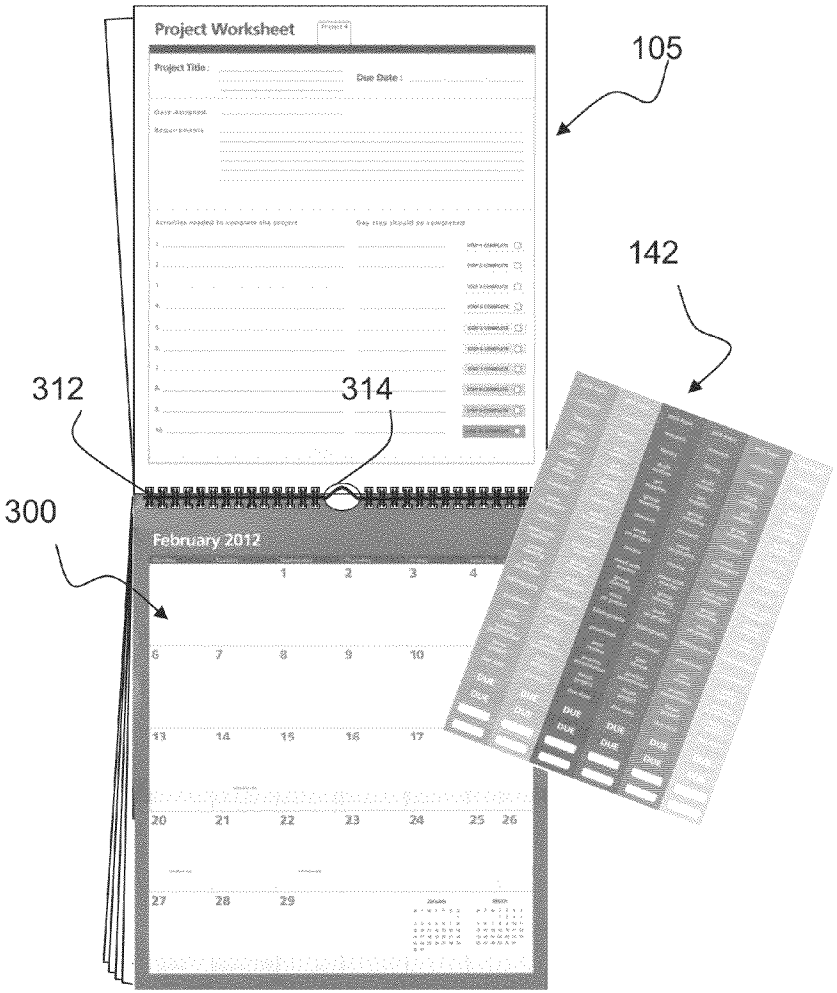

FIG. 15 shows a wall calendar 300, which may comprise multiple pages, for example each covering one month as shown The pages may be connected by a binding 312 such as a twin-wire, spiral wire, glued, stapled, looseleaf, clips, mechanical fasteners, or stitched binding, or any other type of binding. A mounting hanger 314 may be provided to hang on a wall, although the calendar may also be provided with other mounting such as magnetic, or may be used on a horizontal surface such as a desk where it may serve as a desk pad. The reverse side of each page may be printed with a project worksheet 105, or project worksheet pages may be provided as separate sheets either bound or by binding 312 or unbound. A sheet of labels 142 may be provided as a loose page, or may be bound into binding 312. If desired, the labels may be colored or shaded and the coloring or shading may be graduated to indicate a progression along the project timeline. For example, the colors may progress from white to blue to yellow to red (or any other color sequence) as the project timeline proceeds, or the color or shading may be made darker (or lighter) as the project timeline proceeds. The labels may be made with different colors for use by different persons, for example, to facilitate the shared use of the calendar and project worksheets between members of a family or a student group.

Figure 16:
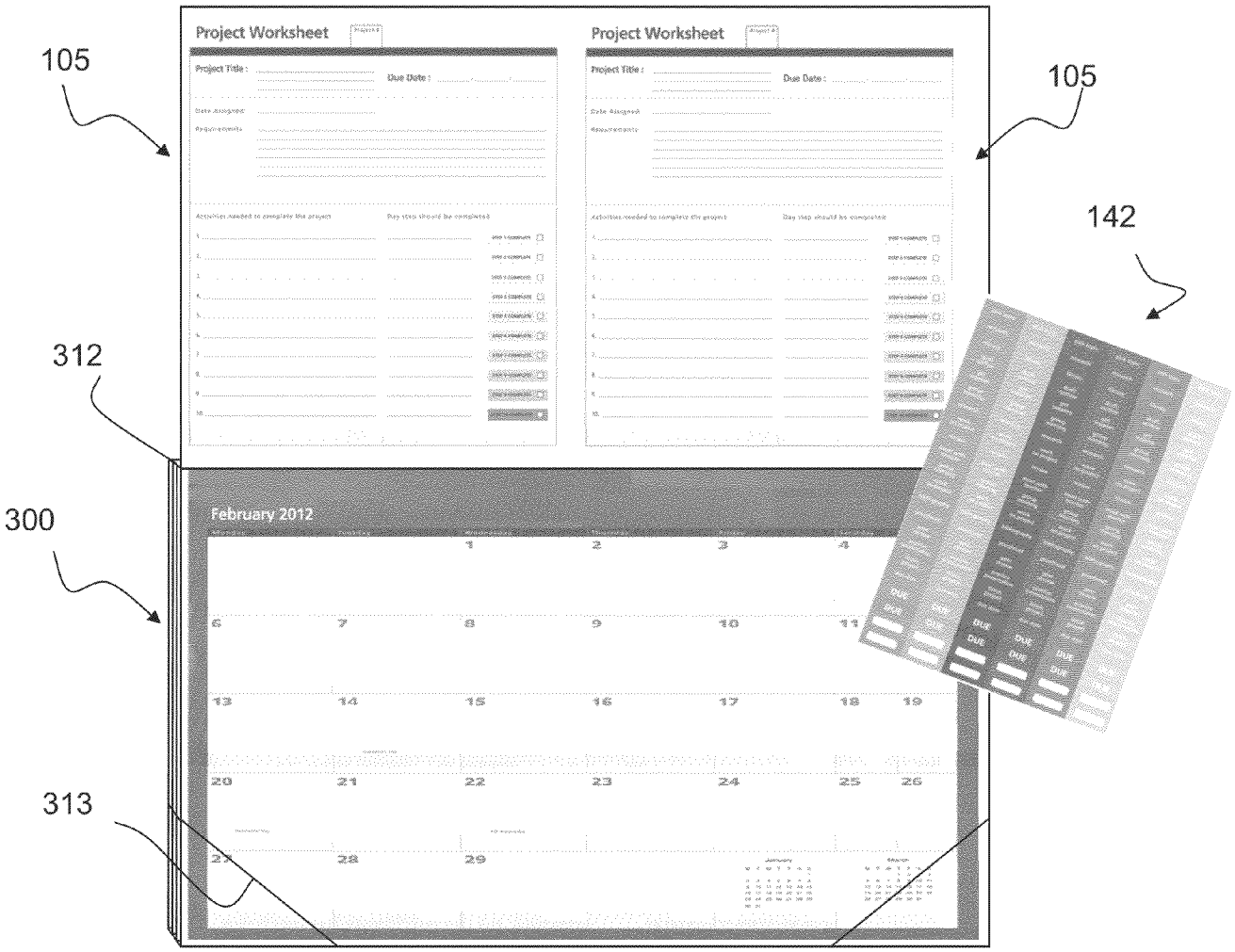

FIG. 16 shows a desk calendar 300, which may comprise multiple pages, for example each covering one month as shown The pages may be connected by a binding such as glued, stapled, looseleaf, clips, twin-wire, spiral wire, mechanical fasteners, or stitched binding, or any other type of binding. Corner attachments 313 may be provided such as pockets, elastic loops, or other means to help hold the pages. The reverse side of each page may be printed with one or more project worksheets 105, or project worksheet pages may be provided as separate sheets either bound by binding 312 or unbound. A sheet of labels 142 may be provided as a loose page, or may be bound into binding 312. If desired, the labels may be colored or shaded and the coloring or shading may be graduated to indicate a progression along the project timeline. For example, the colors may progress from white to blue to yellow to red (or any other color sequence) as the project timeline proceeds, or the color or shading may be made darker (or lighter) as the project timeline proceeds. The labels may be made with different colors for use by different persons, for example, to facilitate the shared use of the calendar and project worksheets between members of a family or a student group.

Figure 17:
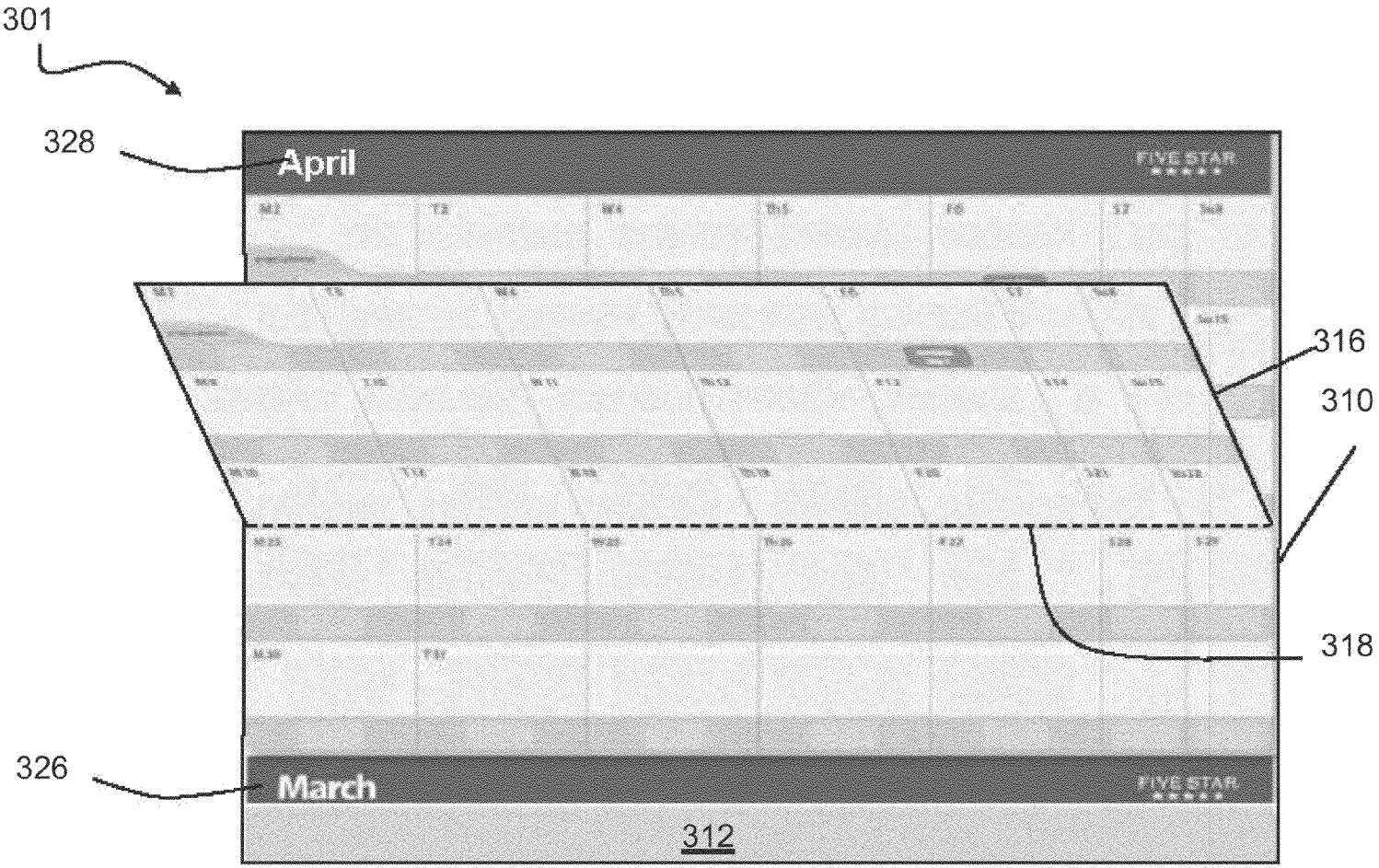

Instead of the calendars 300 as shown on FIGS. 14-16, a "continuous" calendar 301 may be used as shown in FIG. 17, such as the continuous calendar disclosed in U.S. Provisional Application 61/260,964 filed Nov. 13, 2009. Such a continuous calendar may have a plurality of pages 310 bound together on one or more sides by one or more binding mechanism(s) 312. In the illustrated example, the binding edge may be the lower edge of the calendar. There may be two or more calendar pages 310, one or more of which may have one or more perforations or fold lines 318 that allow a page portion 316 to be removed (e.g. torn away) or folded (e.g. backward out of sight). Such calendar pages may have a traditional month calendar format with the month indicator placed in one or more locations of each calendar page and showing each day of the month. In the example of FIG. 17, there may be a month indicator 326 at the lower edge of the calendar (e.g. "March") and/or a month indicator 328 at the upper edge of the calendar (e.g. "April"). When an early portion of an upper page, e.g. the first three weeks of March, have passed, the user may then fold or tear along fold line 318 to remove or foldably hide page portion 316, thus revealing an early portion of the next page, e.g. the first few weeks of April, while still showing the remaining two weeks of March. One or more perforation lines 318 may be provided to allow the user flexibility in determining which weeks are visible.

Such calendar pages may have spaces designated to allow the user to fill in appointments or the like on each day. The calendar may also have one or more spaces on a page to allow the user to write notes or comments. Such a calendar page may also have a space to view previous and following months.

A continuous calendar 301 may have its binding mechanism 312 located across the bottom as compared to the calendar orientation. Such a location may allow the user to more easily remove or fold a page portion 316 of the calendar page along a line 318 that may be perforated to allow the user to easily remove that portion of the page. Such a line may also be manufactured such that the calendar page creases easily in that location by using score lines. Methods to manufacture a removable portion of the page or an easily folded portion of a page may include providing the spaced breaks in the page, perforations, holes, weakened spots in the page, embossing, debossing or any combination of these. The appropriate method to use may be determined by manufacturing preferences.

The intended crease line 318 may be designed to run parallel to the orientation of the weeks on the calendar page, and the crease line may be located beneath the first full week of the month, or beneath the second full week or third full week of the month. Multiple lines may be placed on each calendar page. The calendar pages may have two or more perforations. The perforations or score lines may extend across the majority of the continuous calendar page to more easily allow the user to fold or separate the top portion of the page.

The calendar pages may be removably attached to a binding or binding mechanism. Perforations may be placed along the edge of binding. It is to be understood that score lines could be used in lieu of perforations to allow to user to more easily fold back the pages of the continuous calendar. In the alternative a binding or binding mechanism could be located at two or more corners. The binding or binding mechanism may be cardboard or plastic, adhesive material, paper, fabric, staples, wire, spiral, tape or stitching. Corner binding mechanism(s) may be triangular, round or any other shape. They may also be paper, wire, staples, adhesive, tape, fabric stitching or any other similar materials or combinations thereof. Corner binding mechanisms may be removably attached, loosely holding the plurality of pages together.

Figure 19:
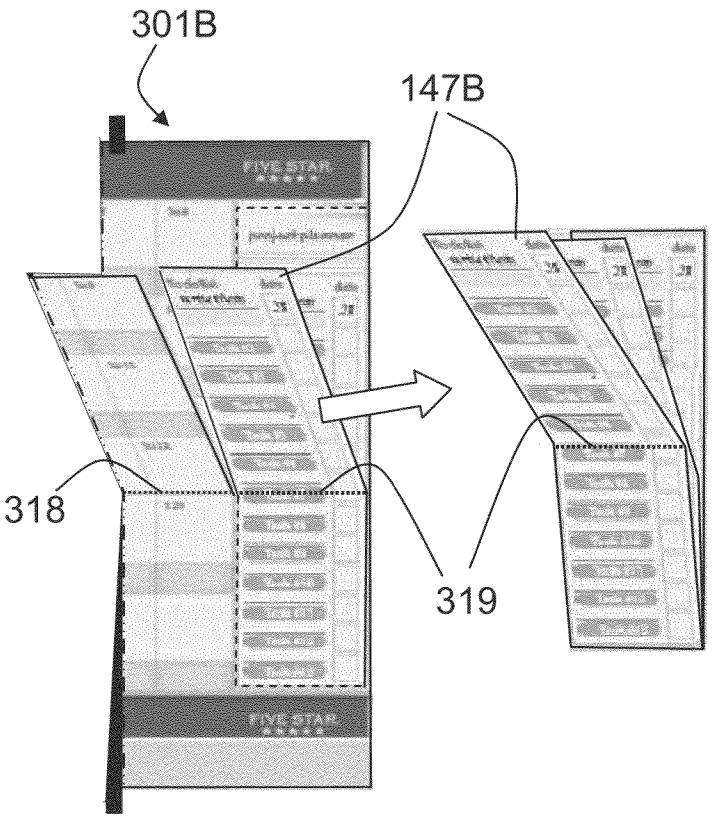
FIGS. 18 and 19 illustrate calendars with removable bookmarks.
Figure 18:
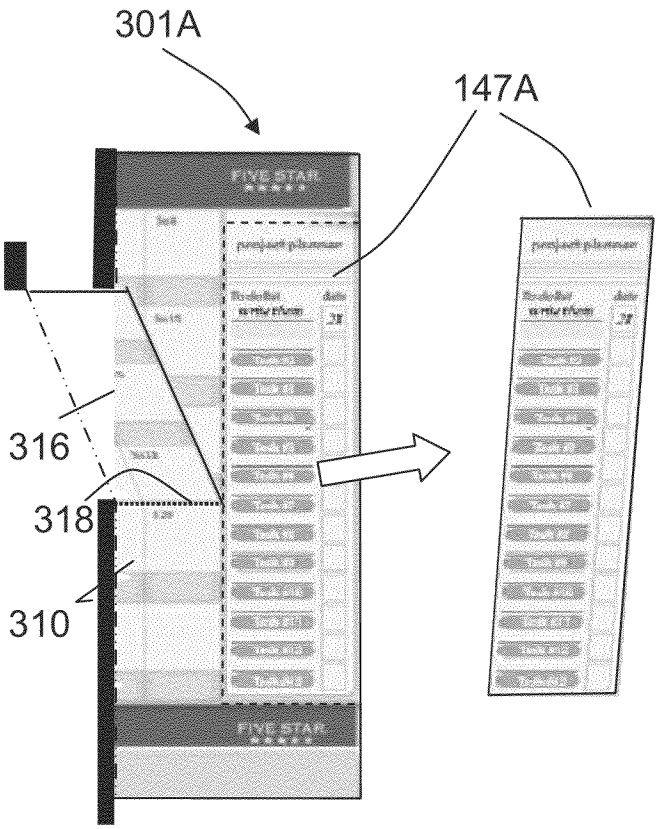

FIG. 18 shows that a portion of an edge of calendar 301A, for example the right edge of the calendar, may be provided with one or more punch-out cards in the form of to-do list or bookmark 147A. The user may write information on bookmark 147A, and the bookmark may also comprise labels or stickers related to a project. The bookmark 147A may then be removed and placed elsewhere in calendar 301A, or in another calendar, or in a planner. FIG. 19 shows how calendar 301B may be provided with one or more bookmarks 147B with crease or fold lines 319 located in correspondence or alignment with crease or fold lines 318 in the calendar itself. The bookmark 147B may have more than one crease line and/or may have more than one layer. Bookmark 147B may be removed and placed elsewhere as desired.

Figure 20:
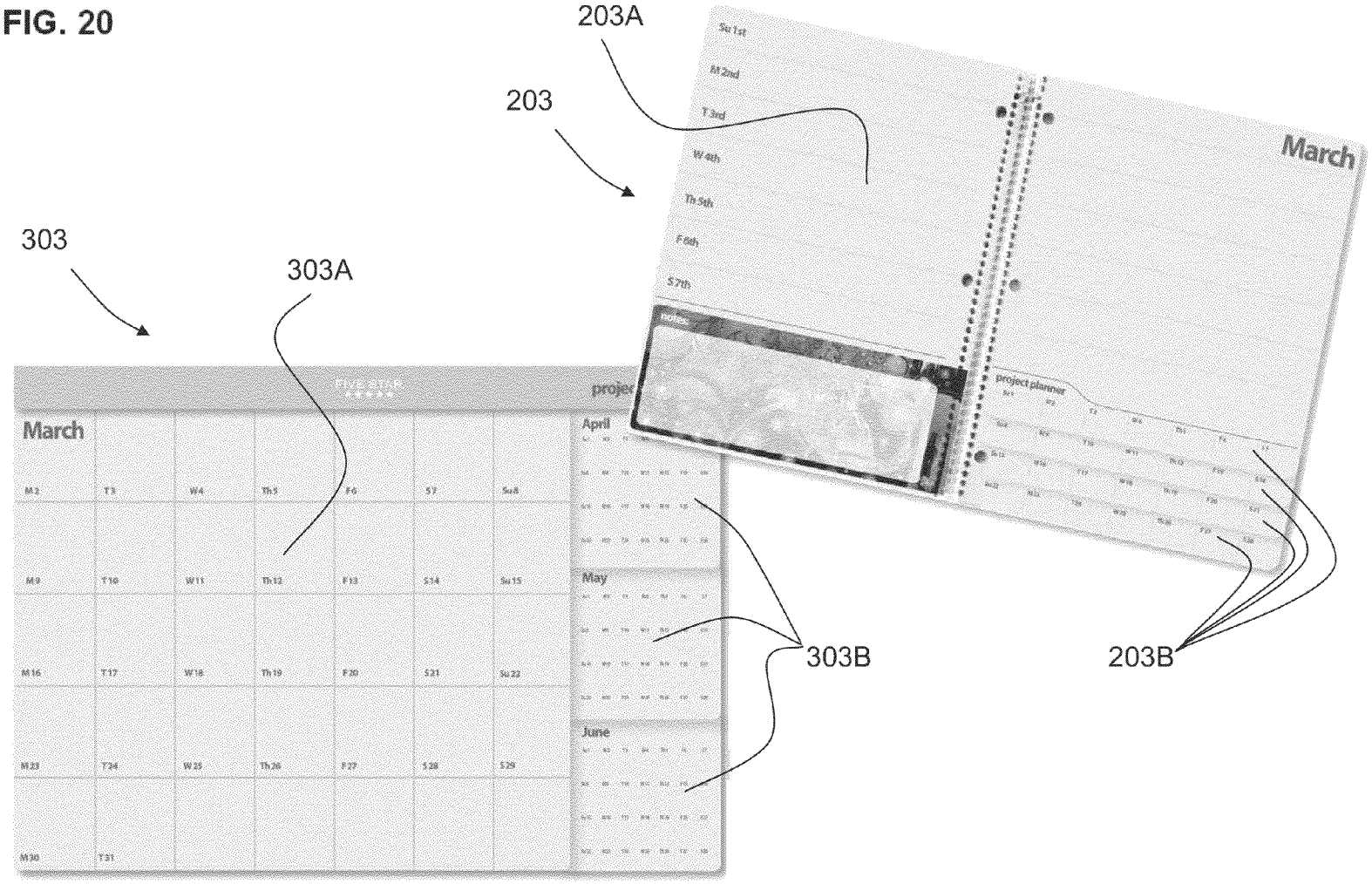
FIG. 20 illustrates a calendar and planner with cutaway sheets.

FIG. 20 shows a calendar 303 which has a main month area 303A (e.g., displaying March) along with one or more cutaway areas 303B, for example showing other months (e.g., April through June). Just as the main month area 303A may have multiple layers, for example, all the months in a year, a semester, a quarter, or other time interval, the cutaway areas 303B may likewise comprise multiple layers of information. The layers or pages of main month area 303A may be moved (e.g. flipped through) independently of the layers or pages of cutaway areas 303B. Also shown is a planner 203 which has a main area 203A (for example representing a week), but also one or more cutaway areas 203B, for example representing adjacent weeks, or all the weeks of the month.

Figure 21B:
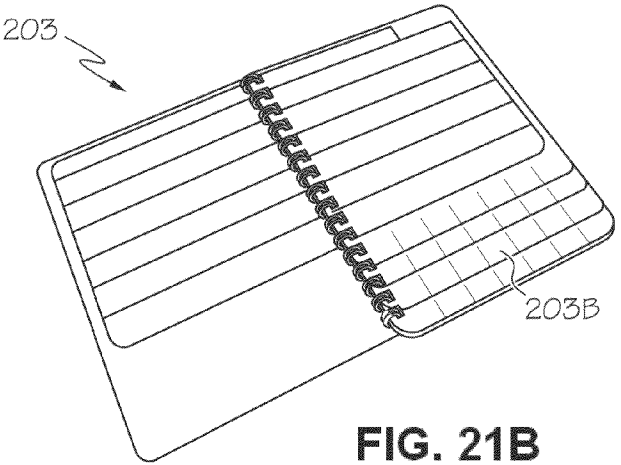
FIGS. 21A-D illustrate various views of the planner of FIG. 13.
Figure 21D:
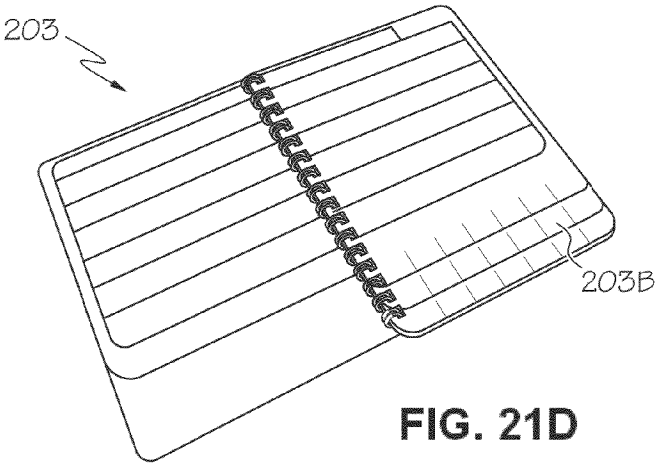
Figure 21A:
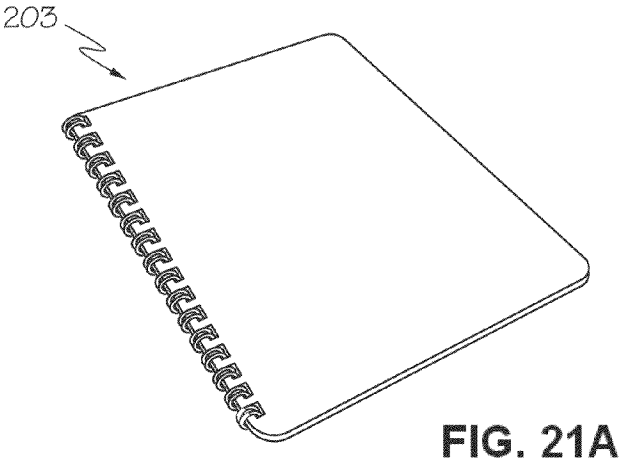
Figure 21C:
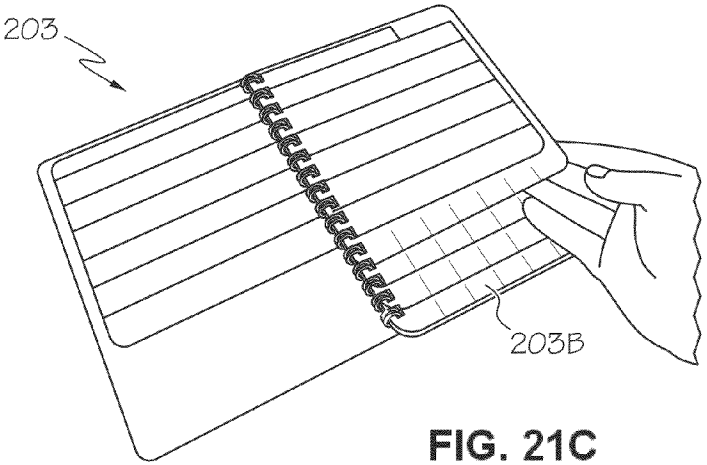

FIGS. 21A-21D show various views of parts of a planner 203. FIG. 21A shows the first page of a section, such as a monthly section, in this case for one Month (e.g. March) although it could be made for a longer or shorter time frame. FIG. 21B shows an internal view of planner 203 for a first week, e.g., March 1-7. The cutaway area 203B comprises four layers, e.g., one per week. FIG. 21C shows a user turning to a next page by using the cutaway area 203B. FIG. 21D shows the internal view of planner 203 after turning the page to the next week, e.g., March 8-14, after which the cutaway area 203B comprises one less layer corresponding to one fewer weeks remaining in the month.

Figure 22:
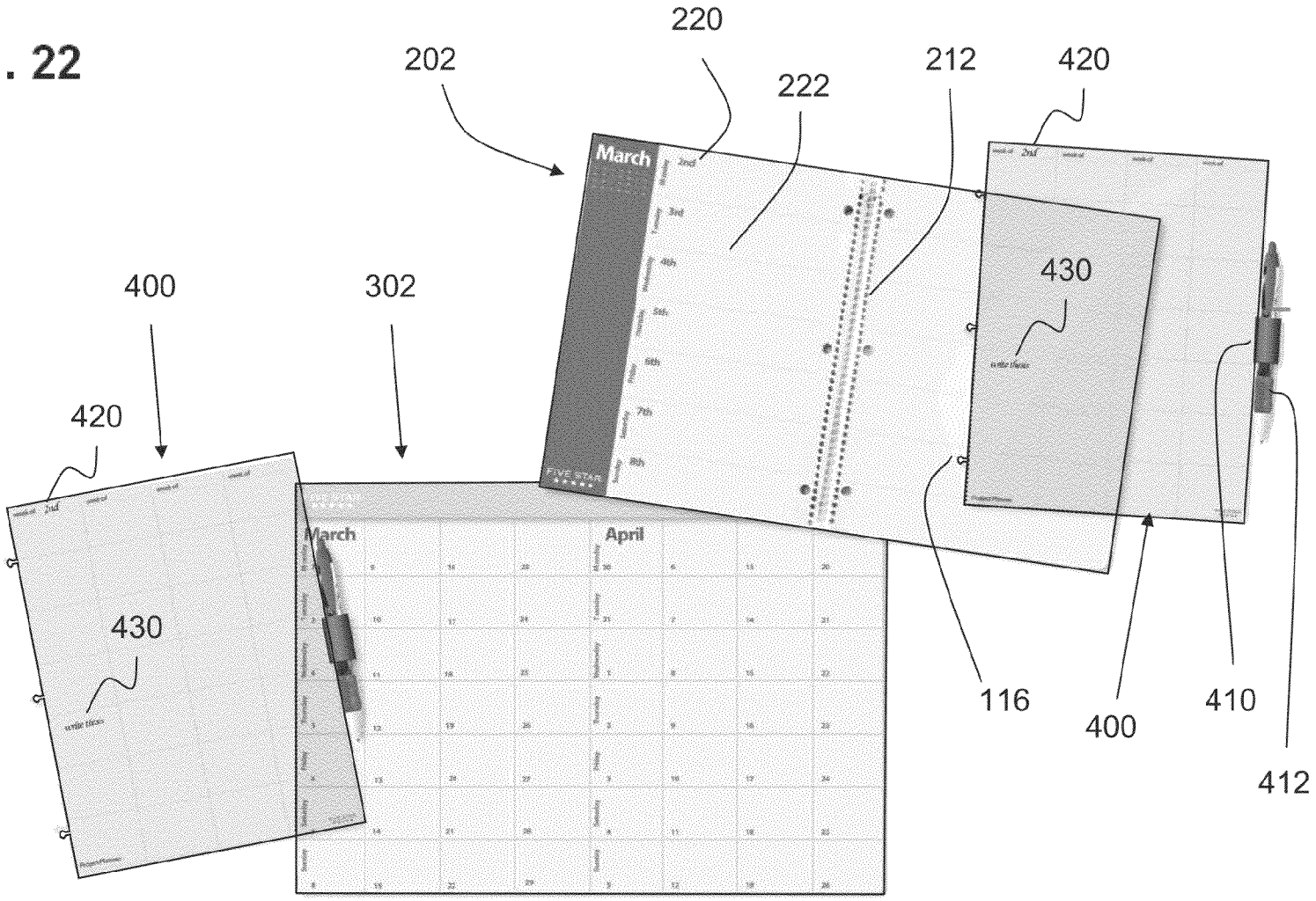
FIG. 22 illustrates a planner and calendar used with an overlay sheet.

FIG. 22 shows an overlay sheet 400 that may be used with a planner (such as planner 202) and/or a calendar (such as calendar 302). The overlay sheet may be transparent. It may be dimensioned and optionally marked to overlay the planner 202 and/or calendar 302 so that indicia 420, 430 marked on the overlay sheet may then correspond equally well to either the planner or calendar. Furthermore labels 140 (not show) may also be placed upon overlay sheet 400 and may then correspond equally well to either the planner or calendar.

FIG. 22 is just one example of how the overlay may correspond to the planner and the calendar, overlay 400 may be provided with columns corresponding to weeks, and rows corresponding to days of the week. Planner 202 may be provided with pages corresponding to weeks, and rows corresponding to days of the week. Calendar 302 may be provided with columns corresponding to weeks, and rows corresponding to days of the week. Here, the rows of the overlay, planner, and calendar correspond to days of the week. Preferably each row occupies the same vertical distance, so that the rows (e.g. days) of overlay 400 when placed upon either planner 202 or calendar 302 will correctly be located over the same rows (e.g. days) of the planner or calendar.

To further explain, indicia 420 indicating a date (e.g. "2nd") may be placed appropriately near the top left of the overlay 400. Indicia 430 indicating a step (e.g. "write thesis") may be placed upon an area of the overlay corresponding to a particular date (e.g., Friday the 6th). Then when the overlay is appropriately placed (e.g. upon the planner page starting with Monday March 2, or upon the calendar region starting with the week of Monday March 2) the indicia 430 will display over Friday, March 6 on both the planner 202 and the calendar 302.

The overlay 400 may include attachment points 116, for example to attach to the spiral binding 212 of the planner 202. Holes (not shown) may be provided in the overlay for attachment to a ring binder. A writing instrument holder 410 may be provided on the overlay, as may a writing instrument 412. The writing instrument may be a dry erase or wet erase type suitable for writing on the overlay.

Figure 23:
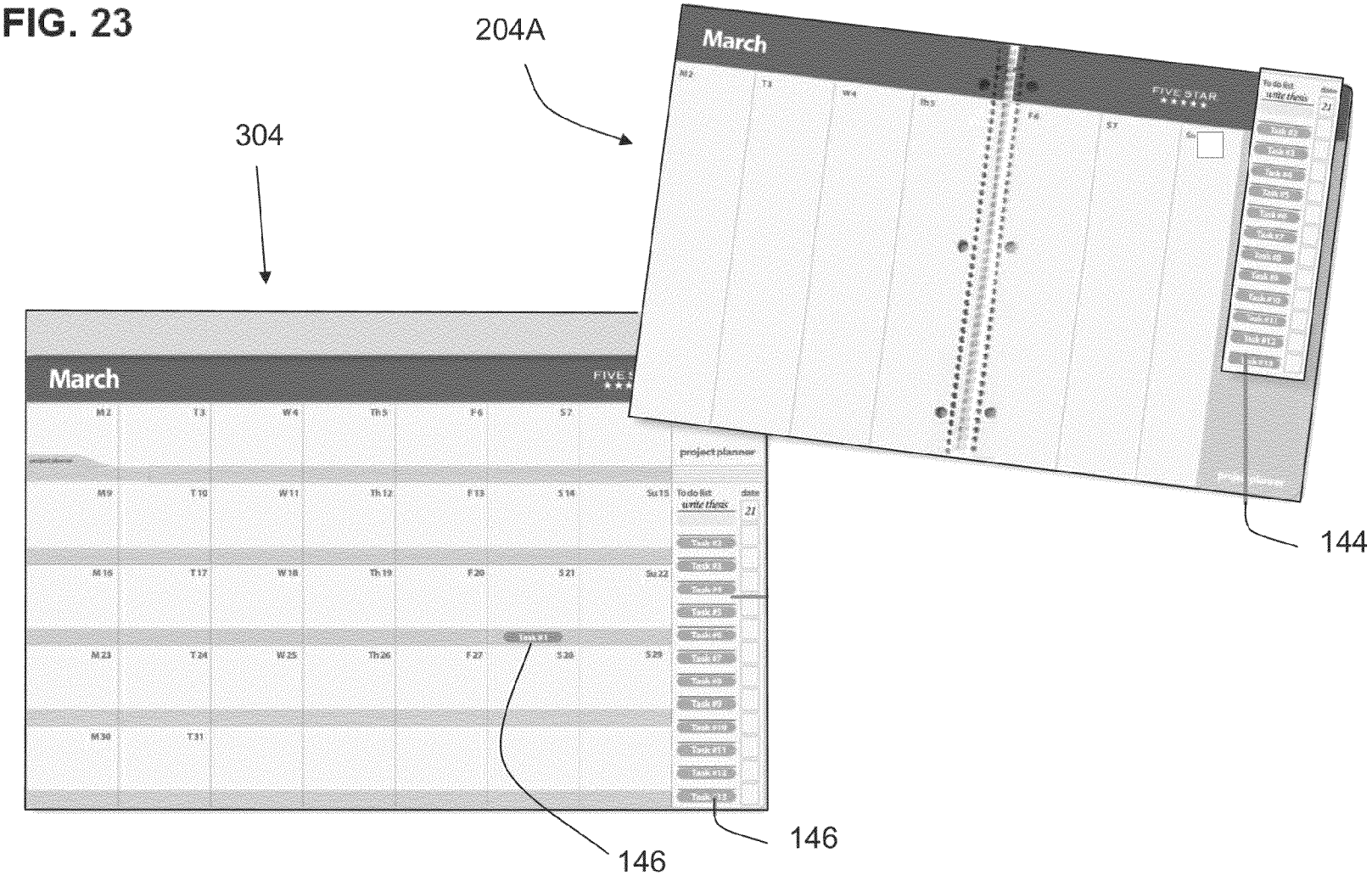
FIGS. 23 and 24 illustrate planners and calendars used with labels.

FIG. 23 shows another planner 204A and calendar 304 which have a set of labels 144, 146 provided along one side. Rather than labels, or in addition to labels, an area for written information may be provided. The labels or area for written information could also be provided along the other side, or the top, or bottom of the planner or calendar. If labels are used, the labels may be backed by a release liner, and may be manufactured integrally with the planner or calendar page (although removable, for example by die cuts) or they may be manufactured separately and then attached into the planner or calendar. The labels may be made with a "carbon paper" functionality so that writing on one label causes the underlying release paper (or another, underlying label) to receive the same written information.

The labels 144 may be provided on one or more pages of a planner or calendar, or on a front or back panel, another panel or flap, or on a bookmark, card, or other structure attached to or provided with the planner or calendar. The labels may be perforated or die cut to facilitate removal. The upper surface of the label may be receptive to ink or other writing material, which may be permanently received, or the upper surface of the label may be a wipe-off or erasable surface so that information written thereon may be removed by the user.

Figure 24:
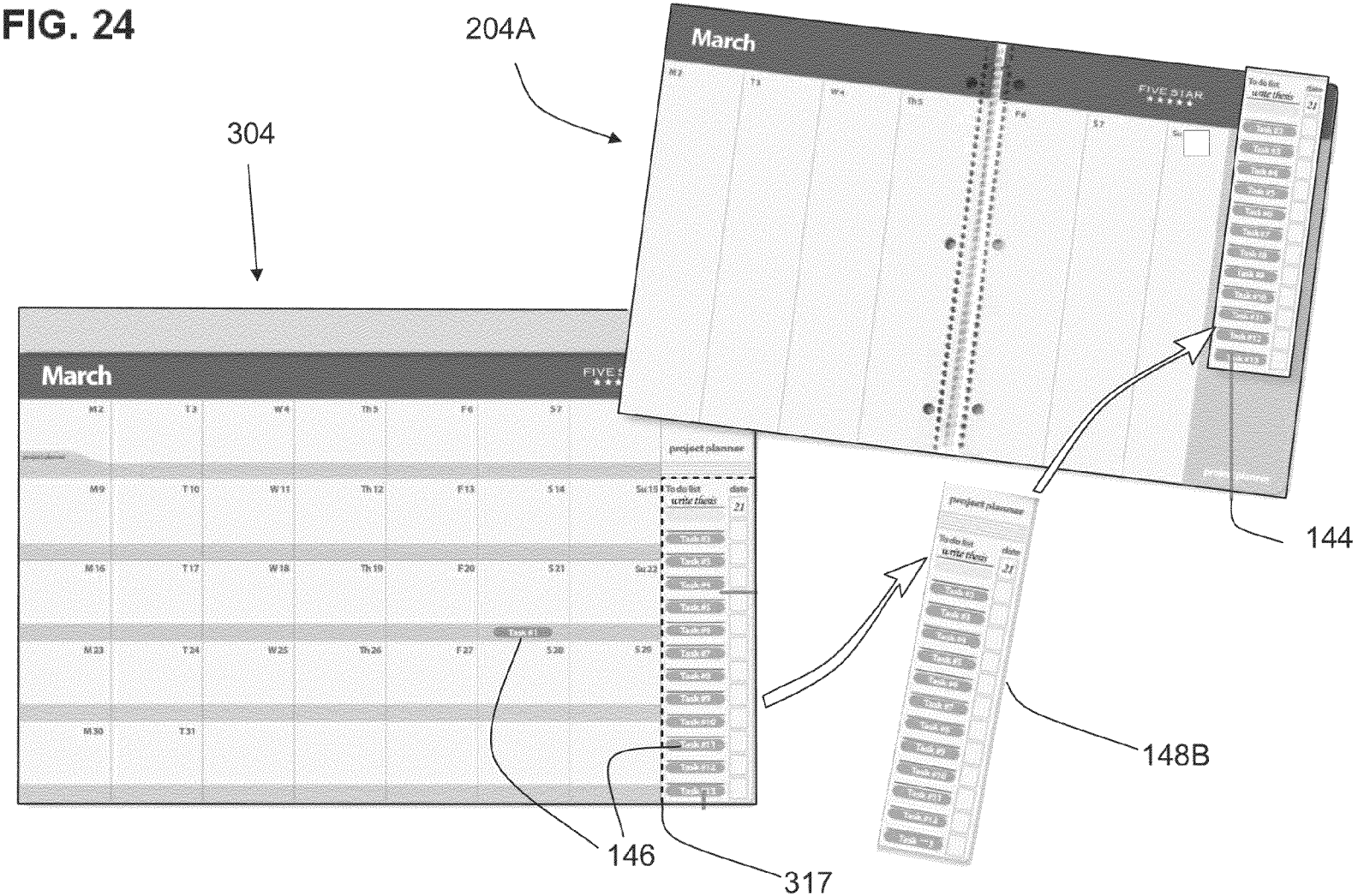

FIG. 24 shows how a label card, sticker card, or information card 148B may be provided on an edge of calendar 304, with perforations 317 to allow the card 148B to be easily removed from the calendar. The removed label card or information card 148B may then be placed on another document, such as planner 204A. It should be understood that the size and location of a label card or information card may differ from that shown in FIG. 24. For example the card may occupy more or less of the height of either the calendar (or planner). It may be have a greater or lesser width than shown, and may be initially located at any edge of the calendar (or planner). Based on manufacturing preferences, it may be beneficial to locate the initial position of the card at an edge other than a bound edge.

Figure 25:
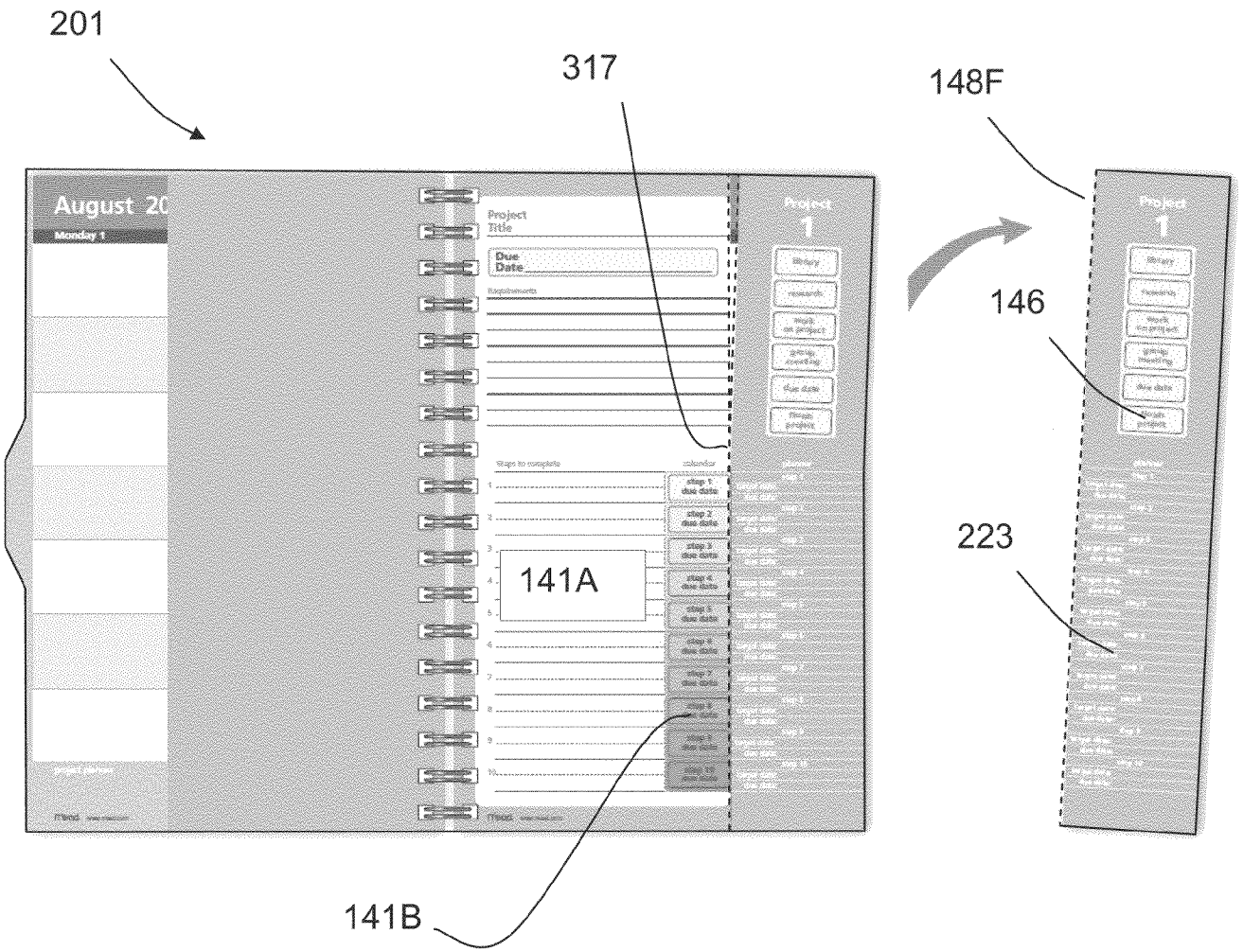
FIG. 25 illustrates a tear-away label card.
Figure 27:
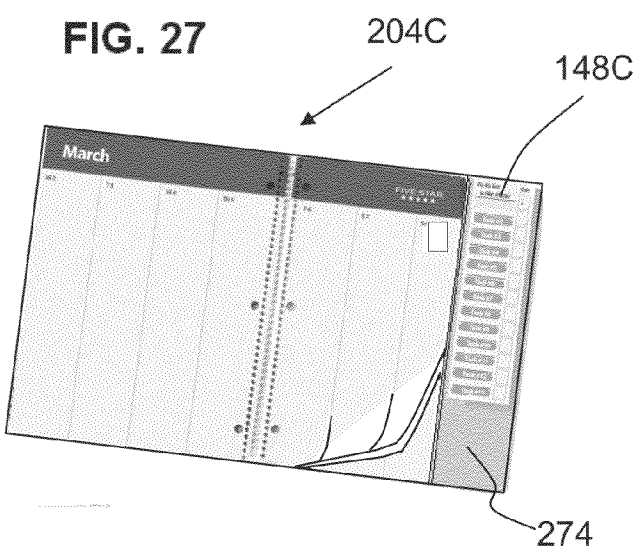
FIGS. 26-31 illustrate alternative ways to provide labels with a planner.
Figure 26:
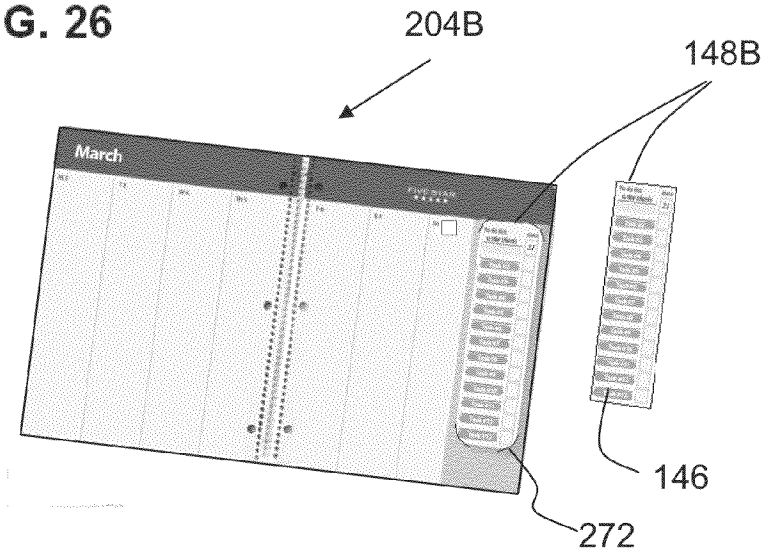
Figure 29:
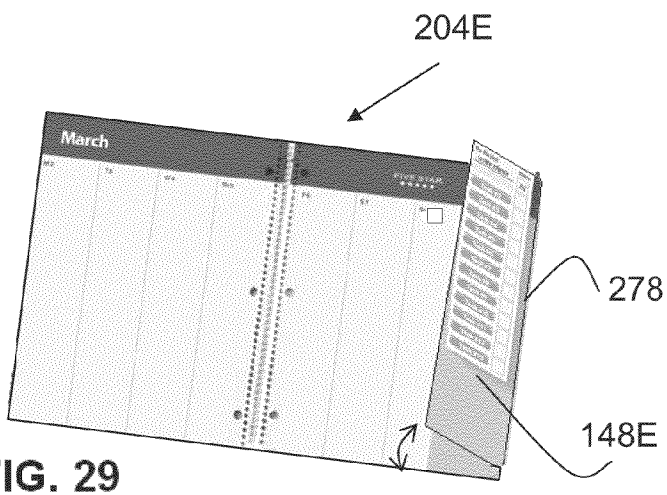
Figure 28:
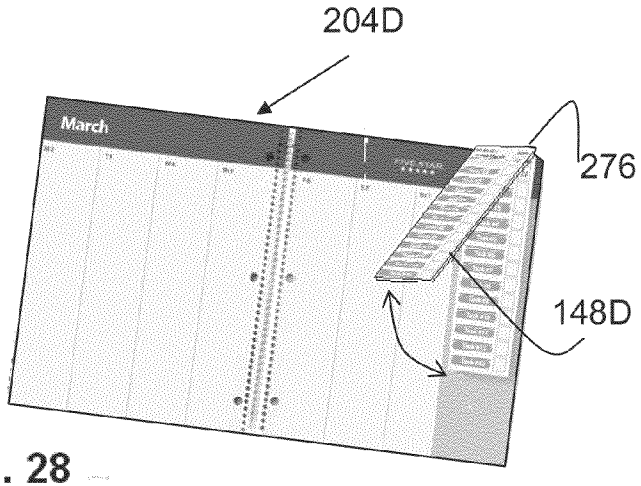
Figure 30:
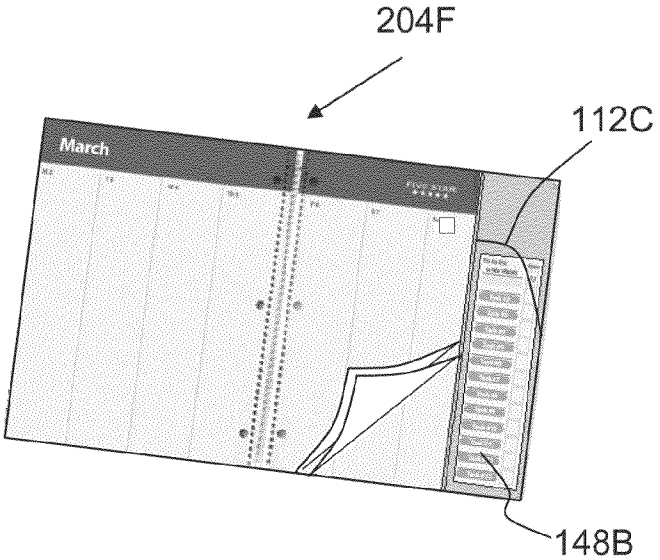
Figure 31:
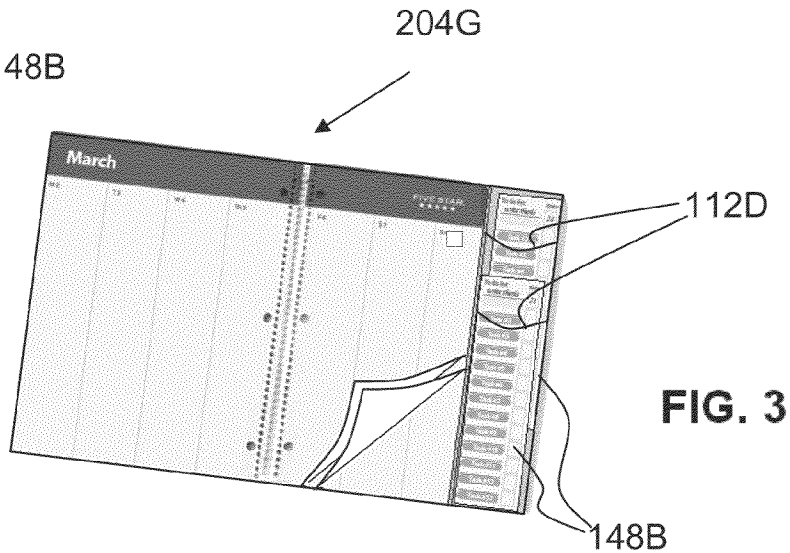

FIG. 25 shows how a label card or information card 148F may be provided on a planner 201, with perforations 317 to allow card 148F to be easily removed from the planner. Card 148F may have either written information area 223 and/or stickers or labels 146. Pages of the planner may also have a written information area 141A and stickers or labels 141B.

FIGS. 26-31 show examples of labels 144 attached in various ways for planners 204B to 204G. Labels could be provided in similar ways for calendars. As shown by planner 204B, a planner may have slots or cutouts 272, or other features that enable pages of the planner to receive a label card 148B or sheet of labels 144. As shown by planner 204C, a planner may have one or more label cards 148C of labels attached to a page such as a back page 274 (or front page, cover, etc). Other pages in the planner may be truncated so that the label card 148C is visible in the truncated area, thus making the label card 148C visible from multiple pages within the planner. As shown by planner 204D, a planner may have one or more label cards 148D of labels, attached to the planner as by a hinged attachment 276, such as a foldable attachment to a back or front page, another page, or a cover, so that the label card 148D may be flipped into position to rest upon any page in the planner. As shown by planner 204E, a planner may have one or more label cards 148E of labels, attached to the planner as by a hinged attachment 278, such as a foldable attachment or extension to an a back or front page, another page, or a cover, so that the label card 148E may be flipped into position to rest upon any page in the planner. As shown by planner 204F in FIG. 30, a planner may have a pocket 112C to receive one or more label cards 148B of labels. As shown by planner 204G, a planner may have multiple pockets 112D to receive label cards 148B. Such pockets 112C, 112D may be attached to a front or rear portion of the planner so that the pockets remain visible from any page of the planner.

Figure 32:
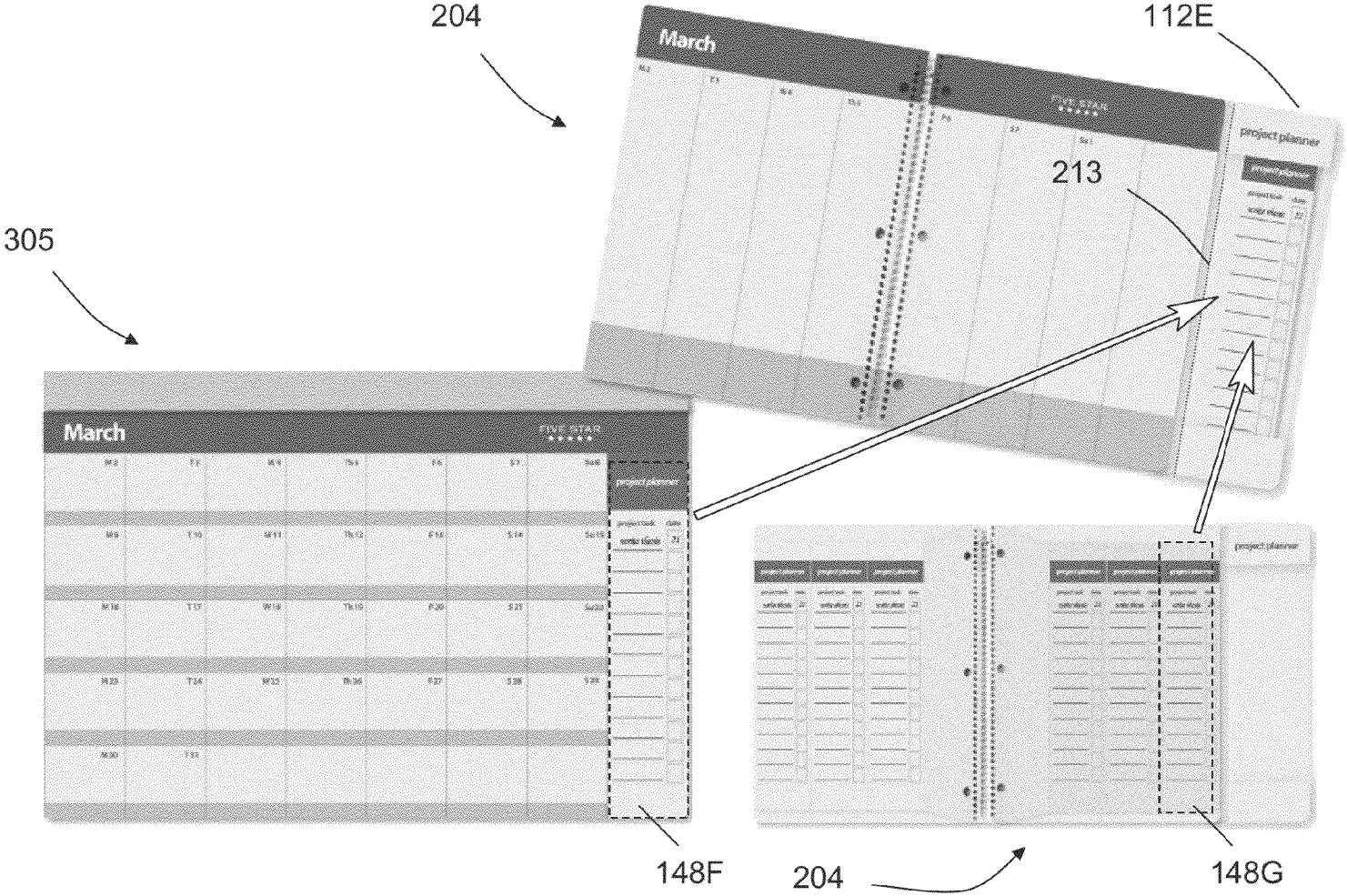
FIG. 32 illustrates the use of a planner with a fold-out pocket.

FIG. 32 shows a calendar 305 which may include a removable bookmark 148F, for example attached by perforations to a calendar page. The bookmark 148F, after removing from the calendar, may be transferred to a pocket 112E provided on planner 204. Such a pocket may be attached to planner 204 for example by a fold or hinge line 213 connected to a back or front cover of the planner. A pocket, if thus hingedly connected to the planner, may be folded inwardly between pages of the planner to provide a place-holding function. Instead of, or in addition to, receiving bookmark 148F from calendar 305, the pocket 112E may receive a bookmark 148G provided elsewhere in the planner 204 itself, for example on a page of bookmark provided in the planner. Pocket 112E may be provided in various forms, such as a small upper pocket and small lower pocket to receive the upper and lower ends of a bookmark or card, as shown in FIG. 32. Other forms for pocket 112E may include a single full-height or partial height pocket, or more than one pocket.

Figure 33:
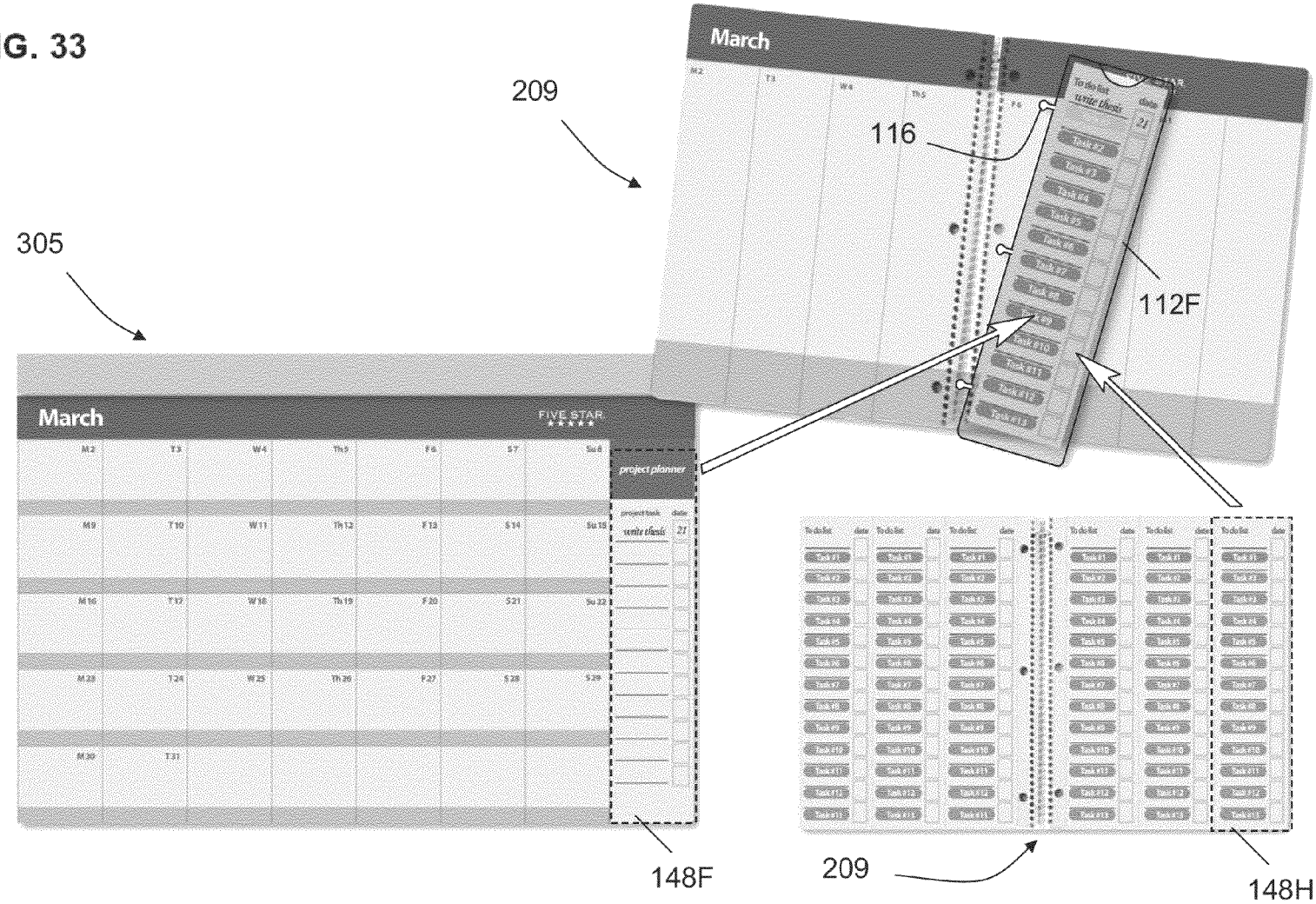
FIG. 33 illustrates the use of a planner with a snap-in pocket.

FIG. 33 shows a movable pocket 112F that may be removably attached into a planner 209 at any page as desired by the user. The pocket may include attachment points 116 for attachment into the planner, for example attachment into a binding mechanism such as a spiral wire. Pocket 112F may receive bookmark 148F from a calendar 305 or from elsewhere in planner 209, or may receive a label or sticker card 148H from elsewhere in the planner itself or from on calendar 305.

Figure 34:
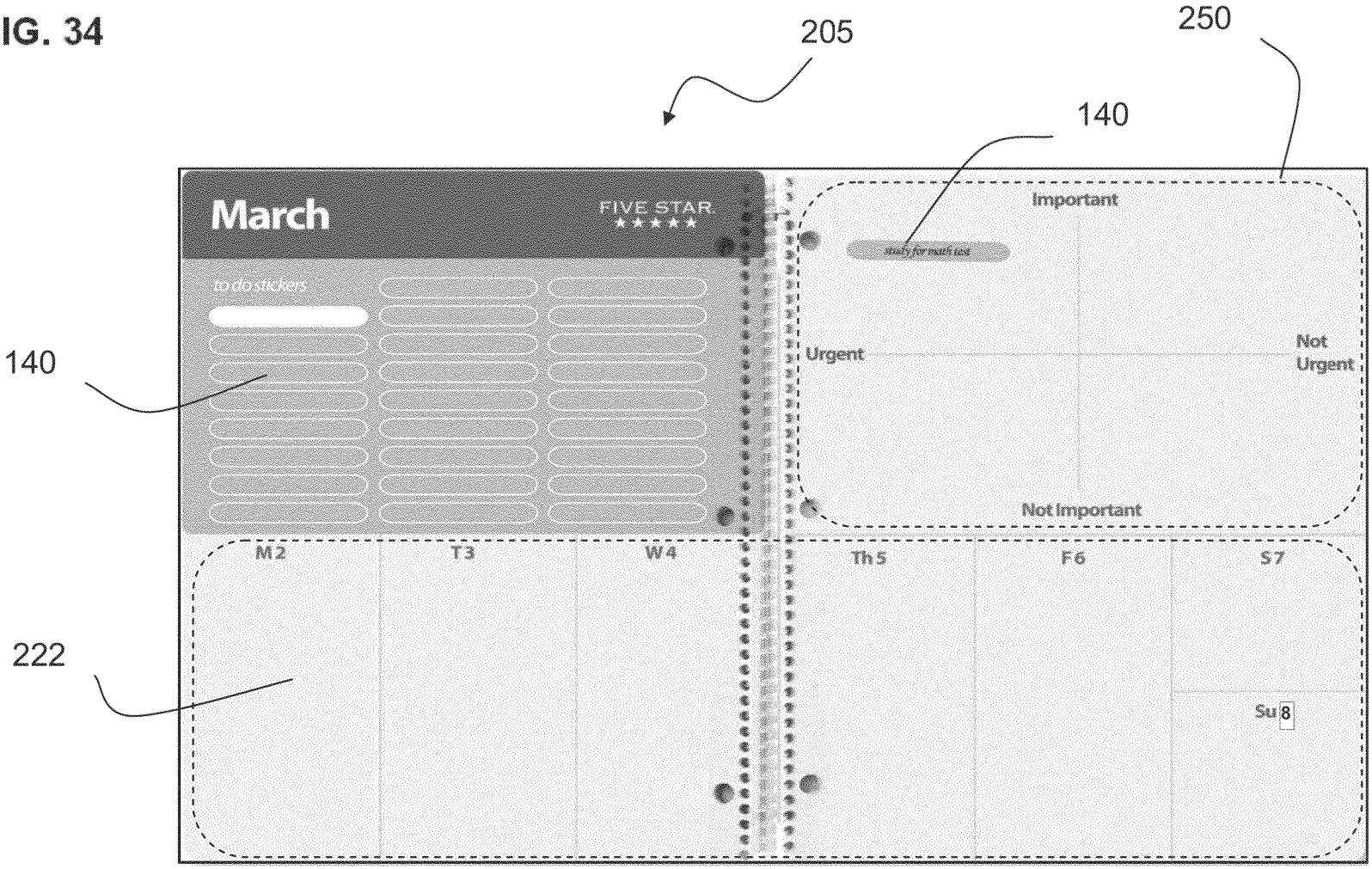
FIGS. 34 and 35 illustrate other planners used with labels.

FIG. 34 shows another planner 205 whose page or pages may have a set of labels 140 provided in one area such as the upper left (as shown) or elsewhere on the page. The labels may be backed by a release liner, and may be manufactured integrally with the planner although removable, for example by die cuts). Alternately the labels may be manufactured separately and then attached into the planner or calendar, for example as separate pages. The labels may be made with a "carbon paper" functionality so that writing on one label causes the underlying release paper (or another, underlying label) to receive the same written information.

An information area 222 may be provided, for example on the lower half of each page of planner 205, to receive information corresponding to a time or date interval, which in this example are the weekdays from Monday, March 2 through Saturday March 7 (and also Sunday March 8). The information may be written information as well as labels 140, either from the planner 205 itself, or from an associated worksheet or calendar. Information area 222 as shown may span more than one page of the planner.

Also shown is an importance map 250 in which information (such as written information or labels) may be placed in sectors according to importance and urgency. For example, the two upper sectors may represent "Important" with the subsets "Urgent" or "Not Urgent", while the two lower sectors may represent "Not Important" with the subsets "Urgent" or "Not Urgent." Thus a user may readily see the urgency and importance of various steps.

Figure 35:
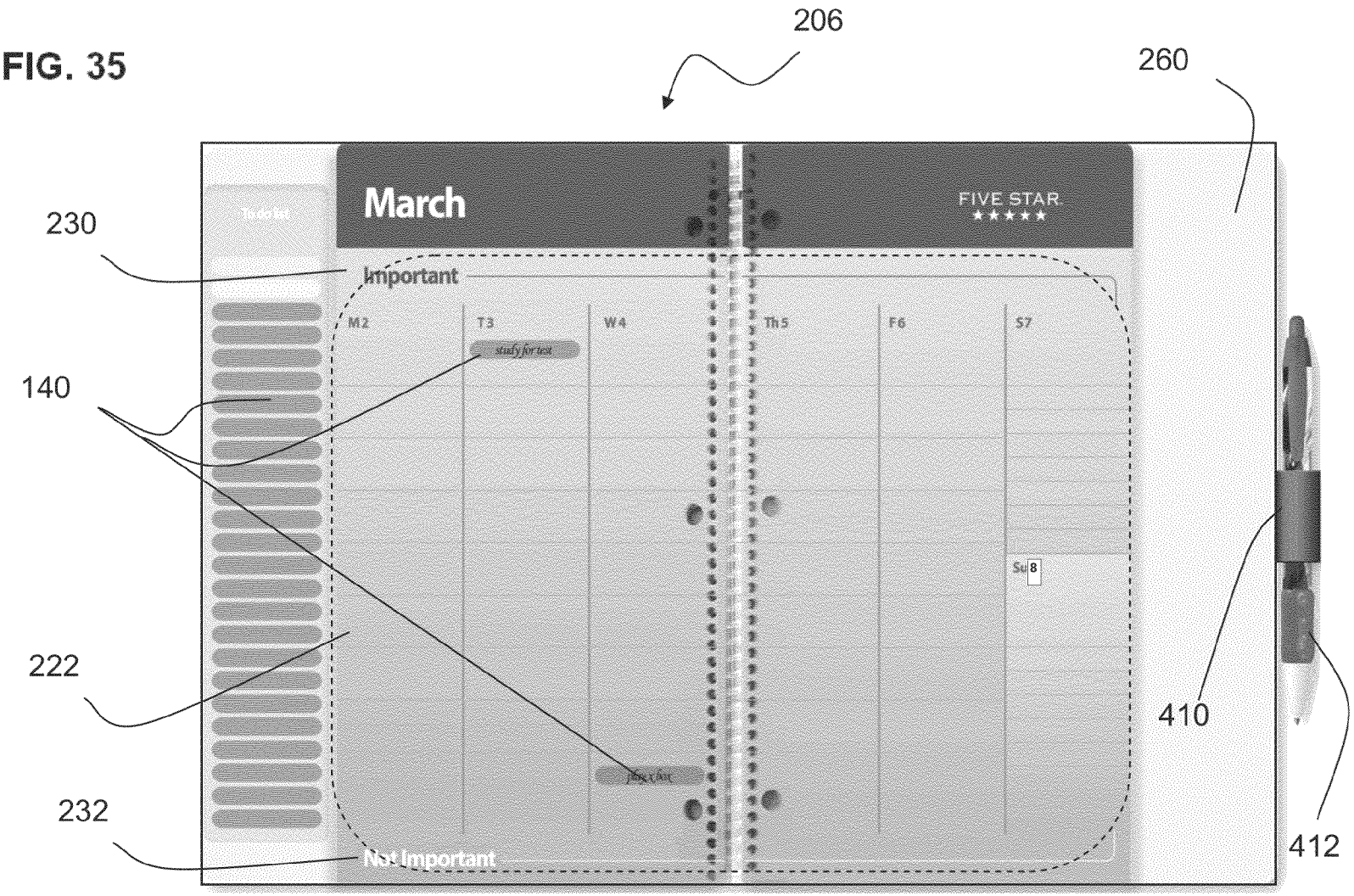

FIG. 35 shows another planner 206 whose page or pages may have a set of labels 140 provided in one area such as the left (as shown) or elsewhere on the page. The labels may be backed by a release liner, and may be manufactured integrally with the planner although removable, for example by die cuts). Alternately the labels may be manufactured separately and then attached into the planner or calendar, for example as separate pages. The labels may be made with a "carbon paper" or carbonless copy functionality so that writing on one label causes the underlying release paper (or another, underlying label) to receive the same written information. The substance thus used for copying may be combined with an adhesive.

An information area 222 may be provided, for example on much of the page (or pair of adjoining pages) of planner 206, to receive information corresponding to a time or date interval, which in this example are the weekdays from Monday, March 2 through Saturday March 7 (and also Sunday March 8). The information may be written information as well as labels 140, either from the planner 206 itself, or from an associated worksheet or calendar. Information area 222 as shown may span more than one page of the planner.

As an indicator of importance of various steps on the planner, the page may be denoted with indicia 230 (e.g. "Important") at an upper part of the page, and indicia 232 indicating lesser importance (e.g. "Not Important") at a lower part of the page. Thus a user may readily see the importance of various steps; for example the important nature of "study for test" on Tuesday, March 3 and the not important nature of "play xBox" on Wednesday, March 4.

Planner 206 may be provided with a cover 260 (as may any of the planners). A writing instrument holder 410 may be provided on the cover or elsewhere on the planner, as may a writing instrument 412.

Figure 36:
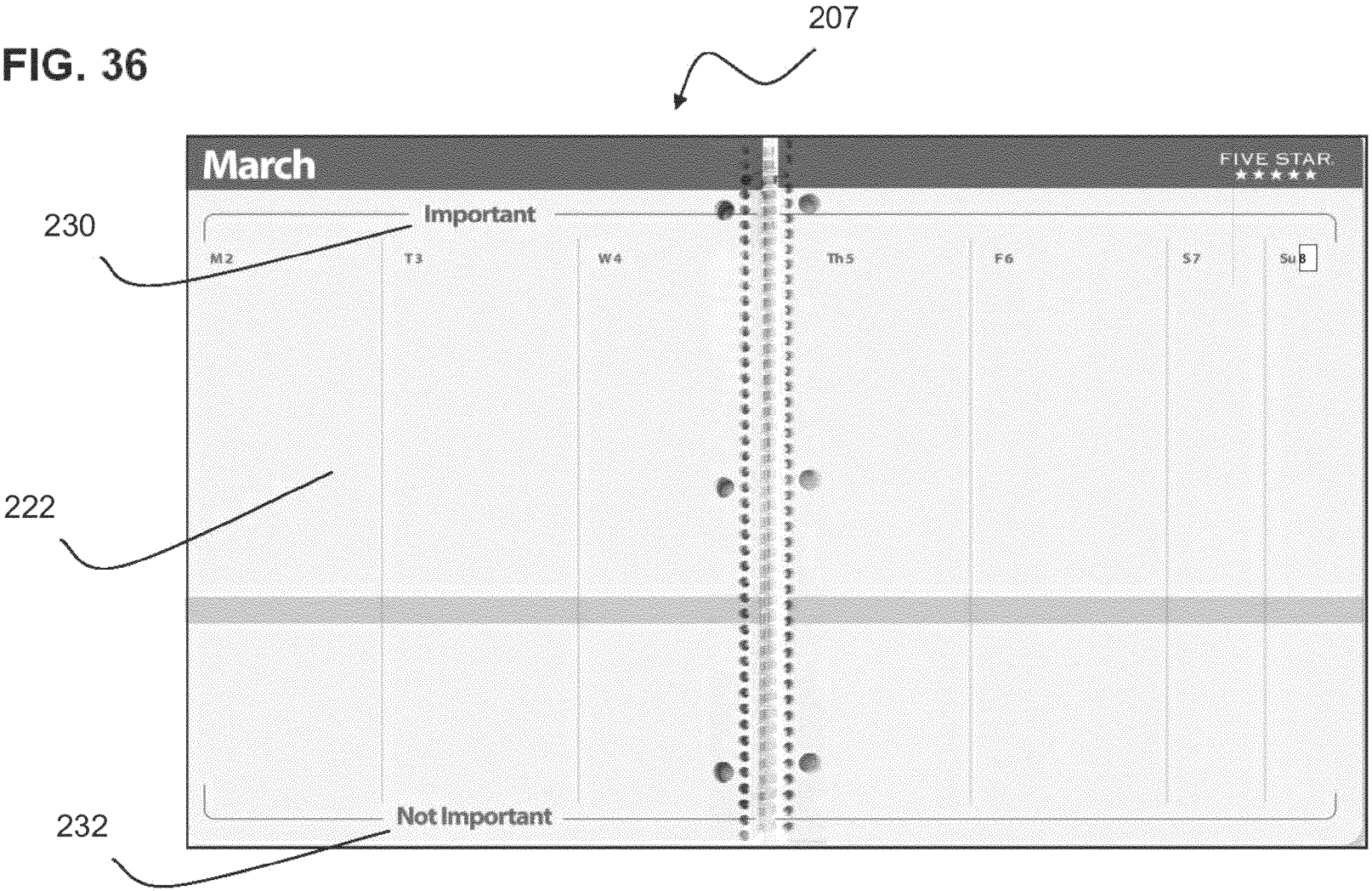
FIG. 36 illustrates a planner with indicia indicating importance.

FIG. 36 shows another planner 207 of somewhat simpler construction. An information area 222 may be provided. The information may be written information as well as labels. As an indicator of importance of various steps on the planner, the page may be denoted with indicia 230 (e.g. "Important") at an upper part of the page, and indicia 232 indicating lesser importance (e.g. "Not Important") at a lower part of the page.

It will be noted that certain of the planners and calendars are multi-page. In such instances, a cutaway may be provided in some pages to provide show-through of other pages that may contain information that applies to several pages.

Figure 37:
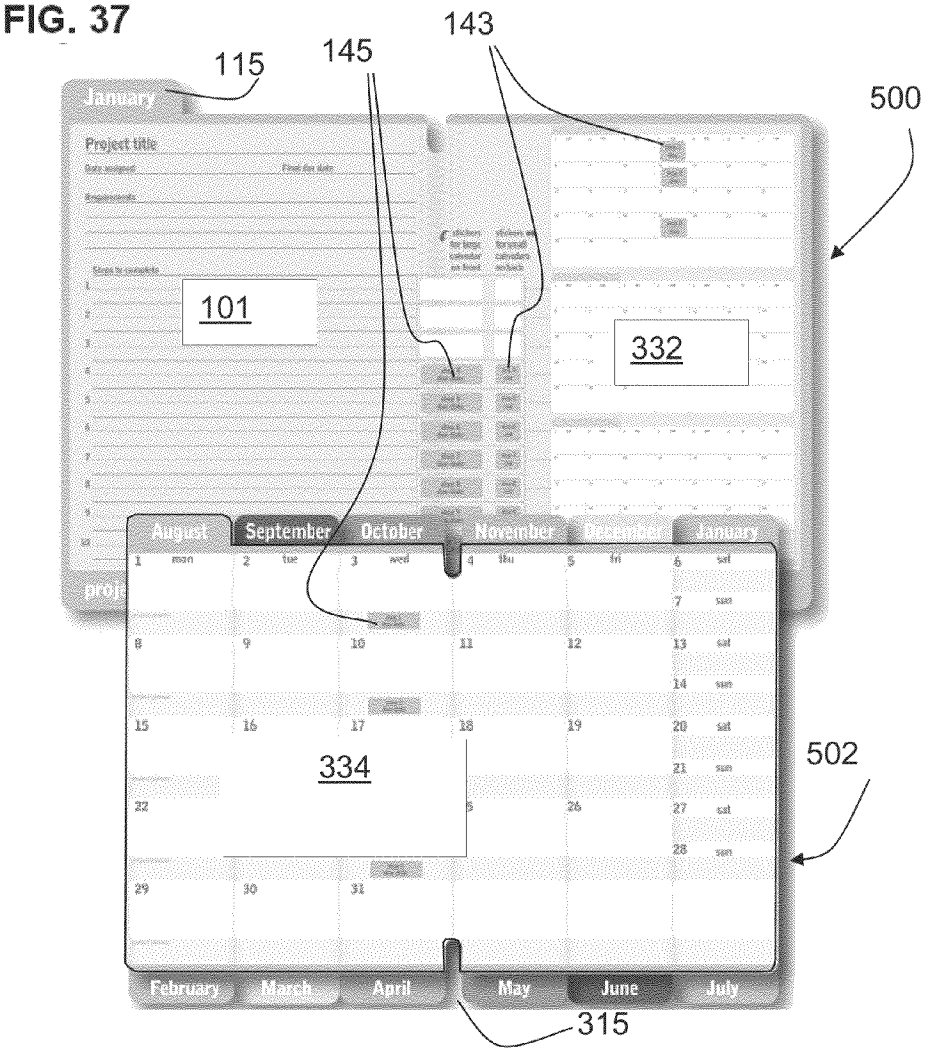
FIG. 37 illustrates pages incorporating calendars and/or a worksheets therein.
Figure 38:
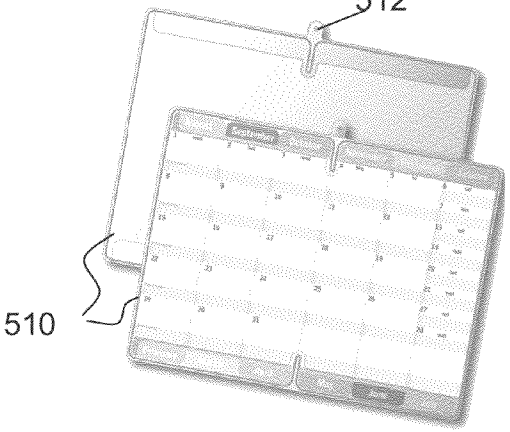
FIG. 38 illustrates a pocket to contain the pages of FIG. 37.

FIG. 37 shows a page 500 which may be one of a group 502 of pages. The pages may for example hold calendar information. Page 500 may include on one surface a worksheet 101 or information area and a first calendar area 332 covering a particular time frame such as one or more months, while the opposite surface may include a second calendar area 334 covering a particular time frame such as one month. Stickers or labels 143, 145 may be provided which are sized appropriately for dates on each of the calendars 332, 334. Each page 500 may include a tab 115, for example displaying the name of a month. In FIG. 37, the group 502 of pages covers an entire year, for which twelve tabs 115 corresponding to the twelve months may be distributed six across the top and six across the bottom of the group 502. The tabs may however be distributed in other groupings and at other locations, for example, all tabs across the top of the group, or all tabs across the bottom of the group, or distributed in various combinations along any of the top, bottom, and sides of the group. As shown in FIG. 38, one or more of the group 502 of pages may be stored together in a binder, folder, sleeve, pocket, bracket, or other device. Such a device may be transparent to provide visibility of at least one page. The pages may for example be stored or received in a pocket or sleeve 510 which is sized to receive the pages. A hang hole 512 may be provided to hang the sleeve on a wall.

Figure 39:
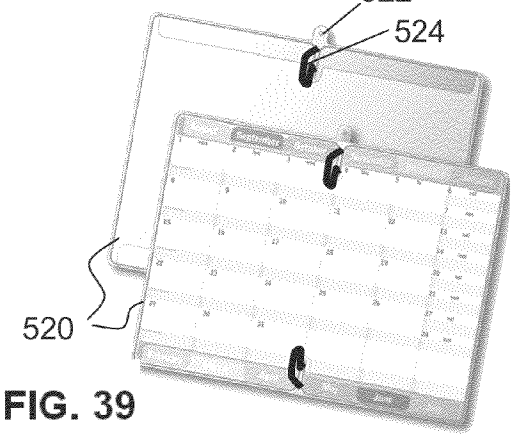
FIG. 39 illustrates a tray to receive the pages of FIG. 37.

As shown in FIG. 39, the pages may also be stored or received in tray 520 which is sized to receive the pages. A hang hole 522 may be provided to hang the tray on a wall. The pages may include a cutout or notch 315 that may be optionally engaged by tray retaining clip or clips 524. The cutout or notch may be on the periphery of the pages, or within the page away from the periphery. Instead of or in addition to clips 524, overhanging ledges may be provided in the tray to retain the pages. Clips, ledges, or other features may be useful for aligning and holding the pages. Elastic bands, strings, wires, etc. may also be used for aligning and/or holding the pages. Alternately the tray may include one or more pins or other protrusions to engage one or more holes or apertures in the pages. Alternately the pages may be provided with tabs to be received or engaged into one or more slots in the frame. Holding/aligning features such as clips 524, or notches, tabs or other aligning/holding features may be located the top and/or bottom of the pages, and/or the left and/or right sides of the pages.

Besides pocket or sleeve 510 or tray 520, the pages 500, 502 may be stored in binders, folders, brackets, or other devices.

FIGS. 40A and 40B show two views of another example of a planner 208 which includes an information area 225 for certain time intervals, such as a week being represented on two facing pages. Dividers 208A may be provided to separate the weeks according to month. The planner may be designed to cover various time ranges, for example five months. The dividers may include a calendar or calendar 208B on one surface, while the reverse surface may include a planning or worksheet area 103, a supply of stickers or labels 145, and a notes area 132.

Figure 41:
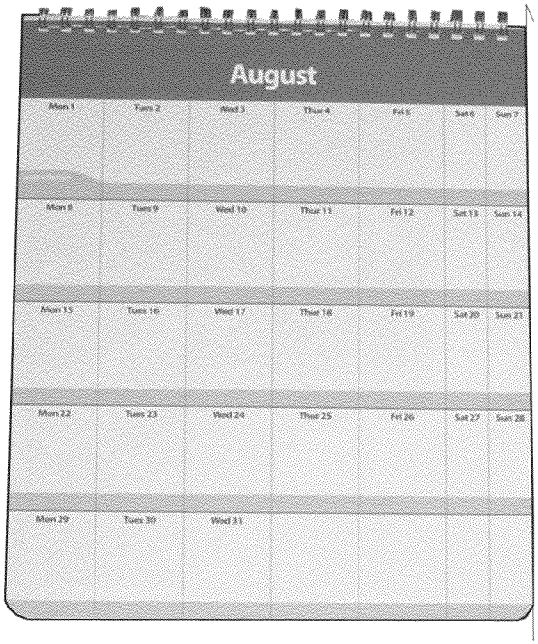
FIGS. 41 and 42 illustrate two examples of spatial alignment of planners and calendars.
Figure 41:
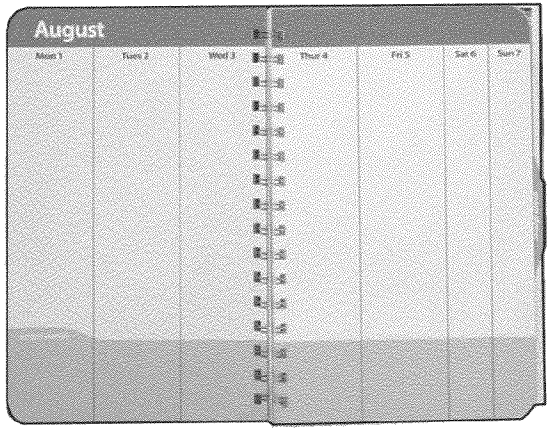

FIG. 41 shows an example of how a calendar such as a wall calendar 309A may be sized and shaped so that dates on wall calendar 309A align with dates on planner 209C. In the Fig. it can be seen that a given day of the week is provided as one of several horizontally-distributed columns, and the given day has equal or approximately equal width and position in both the calendar and planner. Thus the days of the week, for example Monday, or Wednesday, fall in a vertical alignment between the calendar and planner.

Figure 42:
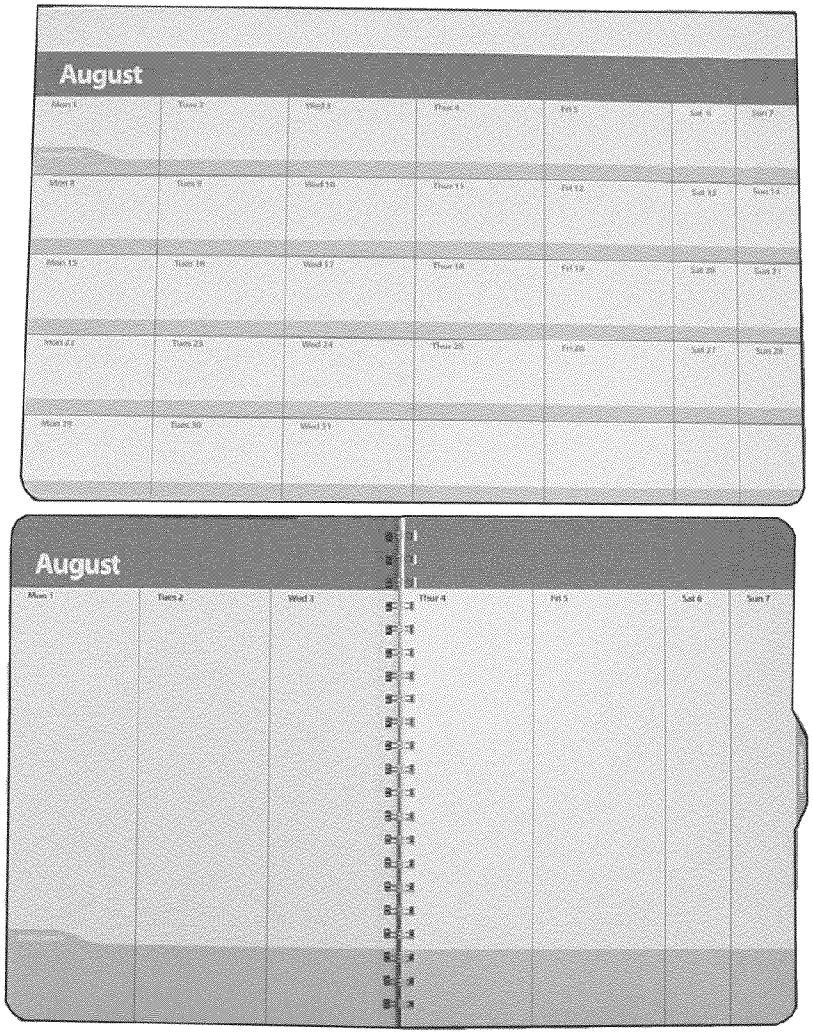

FIG. 42 shows another example of how a calendar such as a desk calendar 309B may be sized and shaped so that dates on desk calendar 309B align with dates on planner 209D. Desk calendar 309B may be wider (or narrower) than wall calendar 309A, and planner 209D may correspondingly be wider (or narrower) than planner 209C. In other aspects the calendars and planners in FIGS. 41 and 42 may be similar.

The use of labels or stickers may improve the efficiency of the project planning system by reducing the amount of repetitive writing required. Further efficiency may be afforded through the optional use of specialty or multilayer labels with carbon or carbonless copying capability. Alternately some labels may be duplicated by using copying such as xerography or printing from a computer.

The worksheets, planners, and calendars described herein may be used with labels, stickers, bookmarks, and cards or bookmarks bearing label or stickers. In certain instances the terms bookmark, label card, and sticker card may be used interchangeably, and the functions of the bookmarks, labels cards, and sticker cards may sometimes be used interchangeably or their features combined. For example a card or bookmark may contain written information as well as labels and/or stickers. Labels or stickers may be blank or plain, or may contain printed or written information. The worksheets, planners, labels (sticker or bookmark) and calendars described here may include step-by-step instructions on their use. The worksheets, planners, labels (sticker or bookmark), and calendars may comprise a wipeable substrate, for example one on which a dry-erase or wet-erase ink may be received and later wiped off or erased.

The worksheets, planners, labels (sticker or bookmark), and calendars described herein can be used independently or together to enable students to develop project planning skills. The use of labels allows information to be transferred between worksheet, planner, and calendar, and moved from date to date, as the project progresses. This makes for efficient organization, better uses the student's time, and helps maintain interest of younger students.

It is to be understood that the materials do not need to be dated. Given the variety of school schedules throughout children's ages and across the world—it may be beneficial to allow users to input date and month information and tailor the planners and calendars to their needs. It may be useful to maintain day indicators on such sheets.

It is understood that the label (stickers or bookmark) may be placed at any location on the worksheets, planners or calendars. However, manufacturing preferences may locate the label on a free edge of a planner, worksheet or calendar so as not to unhinge the rest of the page from the binding mechanism.

Having described the invention in detail and by reference to the various embodiments, it should be understood that modifications and variations thereof are possible without departing from the scope of the invention.

In the claims, the word "phase" is used instead of "step" only to avoid possible confusion with the use of "step" in any eventual method claims. The word "phase" is not meant to be limiting in any way.

What is claimed is:

1. A method of project planning comprising:

accessing a worksheet pertaining to at least two phases of a project, wherein the worksheet has a list area to receive user-inputted information;

inputting, by the user, information pertaining to at least two phases of the project in the list area of the worksheet, wherein the user-inputted information includes at least one of a time interval or a finish date for each of the at least two phases;

accessing a first date-range document and a second date-range document, each date-range document having a date range that includes at least a portion of the time interval or the finish date for at least one phase of the project, each date-range document including a plurality of columns, each column defined by spaced-apart, vertically-oriented borders, wherein the plurality of columns of the first date-range document span two simultaneously-viewable pages thereof, and wherein the plurality of columns of the second date-range document span a single page thereof, and wherein the vertically-oriented borders of the first date-range document are positioned to align with the vertically-oriented borders of the second date-range document when the first and second date-range documents are positioned with their respective columns in an aligned configuration;

inputting at least some of the information from the worksheet to one of the first date-range document or the second date-range document, wherein the information from the worksheet is inputted within one of the plurality of columns of the respective date-range document at a location thereon corresponding with a specific date;

aligning each of the plurality of columns of the first date-range document with each of the plurality of columns of the second date-range document; and inputting at least some of the inputted information from the one of the first date-range document or the second date-range document to the other of the first date-range document or the second date-range document, wherein the inputted information is inputted within one of the plurality of columns of the respective date-range document at a location thereon corresponding with the specific date.

2. A method of project planning comprising:

accessing a worksheet pertaining to at least two phases of a project, wherein the worksheet has a list area to receive user-inputted information;

inputting, by the user, information pertaining to at least two phases of the project in the list area of the worksheet, wherein the user-inputted information includes at least one of a time interval or a finish date for each of the at least two phases;

accessing a plurality of labels, wherein each of the labels includes project-related indicia thereon;

selecting a first label and a second label from the plurality of labels, each of the first label and the second label pertaining to at least one of the at least two phases of the project;

accessing a first date-range document and a second date-range document, each date-range document having a date range that includes at least a portion of the time interval or the finish date for at least one phase of the project, each date-range document including a plurality of columns, each column defined by spaced-apart, vertically-oriented borders, wherein the plurality of columns of the first date-range document span two simultaneously-viewable pages thereof, and wherein the plurality of columns of the second date-range document span a single page thereof, and wherein the vertically-oriented borders of the first date-range document are positioned to vertically align with the vertically-oriented borders of the second date-range document when the first and second date-range documents are positioned with their respective columns in an aligned configuration;

securing the first label to one of the first date-range document or the second date-range document within one of the plurality of columns of the respective date-range document at a location thereon corresponding with a specific date pertaining to the at least one of the at least two phases of the project;

aligning each of the plurality of columns of the first date-range document with each of the plurality of columns of the second date-range document; and securing the second label to the other of the first date-range document or the second date-range document, wherein the second label is secured within one of the plurality of columns of the respective date-range document at a location thereon corresponding with the specific date.

* * * * *